US009428980B2

(12) United States Patent
Evans

(10) Patent No.: US 9,428,980 B2
(45) Date of Patent: Aug. 30, 2016

(54) HYDRAULIC/MECHANICAL TIGHT HOLE JAR

(75) Inventor: Robert W. Evans, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 687 days.

(21) Appl. No.: 13/977,414

(22) PCT Filed: Dec. 30, 2010

(86) PCT No.: PCT/US2010/062499
§ 371 (c)(1),
(2), (4) Date: Jun. 28, 2013

(87) PCT Pub. No.: WO2012/091716
PCT Pub. Date: Jul. 5, 2012

(65) Prior Publication Data

US 2013/0277057 A1 Oct. 24, 2013

(51) Int. Cl.
*E21B 31/107* (2006.01)
*E21B 31/113* (2006.01)
*E21B 4/14* (2006.01)

(52) U.S. Cl.
CPC ..... *E21B 31/107* (2013.01); *E21B 31/113* (2013.01); *E21B 31/1135* (2013.01); *E21B 4/14* (2013.01)

(58) Field of Classification Search
CPC ..... E21B 1/00; E21B 4/06; E21B 4/14; E21B 10/38; E21B 23/00; E21B 31/107; E21B 31/113; E21B 31/1135
USPC ..... 173/1, 13, 17, 90, 91, 73, 78; 175/57, 175/226, 293, 296, 302, 303, 304, 321; 166/98, 99, 178, 301
See application file for complete search history.

(56) References Cited

U.S. PATENT DOCUMENTS 1,459,130 A 6/1923 Young
3,087,559 A 4/1963 Hazen et al.
(Continued)

FOREIGN PATENT DOCUMENTS

GB 1597401 A 9/1981

OTHER PUBLICATIONS

PCT/US2010/062499 International Search Report and Written Opinion Dated Jul. 28, 2011 (8 p.).
(Continued)

*Primary Examiner* — Scott A. Smith
(74) *Attorney, Agent, or Firm* — Chamberlain Hrdlicka

(57) ABSTRACT

A jar comprises a housing including an anvil. In addition, the jar comprises a mandrel telescopically disposed within the housing and including a hammer. Further, the jar comprises an annular chamber radially positioned between the mandrel and the housing. Still further, the jar comprises an actuation assembly disposed in the annular chamber. The actuation assembly includes a first collet disposed about the mandrel, a first trigger sleeve disposed about the first collet and adapted to releasably engage the first collet, and a first biasing member adapted to exert an axial force on the mandrel. Moreover, the jar comprises a lock assembly disposed in the annular chamber. The lock assembly includes a second collet disposed about the mandrel, a second trigger sleeve disposed about the second collet and adapted to releasably engage the second collet, and a second biasing member adapted to exert an axial force on the mandrel.

21 Claims, 9 Drawing Sheets

(56) References Cited

U.S. PATENT DOCUMENTS

| | | | | |
|---|---|---|---|---|
| 3,880,249 | A | 4/1975 | Anderson | |
| 4,081,043 | A | 3/1978 | Juergens | |
| 4,284,153 | A | 8/1981 | Reaugh | |
| 4,361,195 | A | 11/1982 | Evans | |
| 4,566,546 | A * | 1/1986 | Evans | E21B 31/113 166/178 |
| 4,582,148 | A | 4/1986 | Walter | |
| 4,865,125 | A | 9/1989 | De Cuir | |
| 5,086,853 | A | 2/1992 | Evans | |
| 5,103,903 | A | 4/1992 | Marks, II | |
| 5,217,070 | A | 6/1993 | Anderson | |
| 5,232,060 | A * | 8/1993 | Evans | E21B 31/113 166/178 |
| 5,507,347 | A * | 4/1996 | Estilette, Sr. | E21B 31/107 166/178 |
| 5,624,001 | A | 4/1997 | Evans | |
| 5,647,446 | A | 7/1997 | Wenzel | |
| 5,984,028 | A * | 11/1999 | Wilson | E21B 31/1135 166/178 |
| 6,290,004 | B1 | 9/2001 | Evans | |
| 6,557,631 | B1 * | 5/2003 | Spencer | E21B 23/08 166/153 |
| 6,712,134 | B2 * | 3/2004 | Stoesz | E21B 31/113 166/178 |
| 6,729,419 | B1 | 5/2004 | Lee | |
| 6,988,551 | B2 | 1/2006 | Evans | |
| 7,290,604 | B2 | 11/2007 | Evans | |
| 7,293,614 | B2 | 11/2007 | Rose | |
| 7,299,872 | B2 * | 11/2007 | Darnell | E21B 31/1135 166/178 |
| 7,311,149 | B2 | 12/2007 | Evans | |
| 7,451,834 | B2 | 11/2008 | Shears et al. | |
| 7,510,008 | B2 * | 3/2009 | Evans | E21B 31/1135 166/178 |
| 2005/0092484 | A1 | 5/2005 | Evans | |
| 2005/0092494 | A1 * | 5/2005 | McElroy | E21B 31/107 166/301 |
| 2009/0020287 | A1 | 1/2009 | Evans | |

OTHER PUBLICATIONS

Evans, Robert W., et al., "New Innovative Wireline Jar Adds Significant Value by Reducing Fishing Cost," Society of Petroleum Engineers, 2007 SPE Annual Technical Conferences and Exhibition, Anaheim, California, Nov. 11-14, 2007 (SPE 108692) (11 p.).

* cited by examiner

HYDRAULIC/MECHANICAL TIGHT HOLE JAR

CROSS-REFERENCE TO RELATED APPLICATIONS

This application is a 35 U.S.C. §371 national stage application of PCT/US2010/062499 filed Dec. 30, 2010, which is hereby incorporated herein by reference in its entirety for all purposes.

STATEMENT REGARDING FEDERALLY SPONSORED RESEARCH OR DEVELOPMENT

Not applicable.

BACKGROUND

1. Field of the Invention

The invention relates generally to downhole tools. More particularly, the invention relates to jars for applying an axial impact force to a downhole assembly.

2. Background of the Technology

In oil and gas well operations, it is frequently necessary to apply an axial blow to a tool or tool string that is positioned downhole. For example, application of axial force to a downhole string may be desirable to dislodge drilling or production equipment that is stuck in a wellbore. Another circumstance involves the retrieval of a tool or string downhole that has been separated from its pipe or tubing string. The separation between the pipe or tubing and the stranded tool or "fish" may be the result of structural failure or a deliberate disconnection initiated from the surface.

Jars have been used in petroleum well operations for several decades to enable operators to deliver axial impacts to stuck or stranded tools and strings. "Drilling jars" are frequently employed when either drilling or production equipment gets stuck in the well bore. The drilling jar is normally placed in the pipe string in the region of the stuck object and allows an operator at the surface to deliver a series of impact blows to the drill string via manipulation of the drill string. These impact blows are intended to dislodge the stuck object, thereby enabling continued downhole operations. "Fishing jars" are inserted into the well bore to retrieve a stranded tool or fish. Fishing jars are provided with a mechanism that is designed to firmly grasp the fish so that the fishing jar and the fish may be lifted together from the well. Many fishing jars are also provided with the capability to deliver axial blows to the fish to facilitate retrieval.

Conventional jars typically include an inner mandrel disposed in an outer housing. The mandrel is permitted to move axially relative to the housing and has a hammer formed thereon, while the housing includes an anvil positioned adjacent to the mandrel hammer. By impacting the anvil with the hammer at a relatively high velocity, a substantial jarring force is imparted to the stuck drill string. If the jarring force is sufficient, the stuck string will be dislodged and freed.

There are four basic types of jars: purely hydraulic jars, purely mechanical jars, bumper jars, and mechanical-hydraulic jars. Bumper jars are primarily used to provide a downward jarring force. The bumper jar usually contains a splined joint with sufficient axial travel to allow a pipe to be lifted and dropped, causing the impact surfaces inside the bumper jar to come together to deliver a downward jarring force to the string.

Mechanical, hydraulic, and mechanical-hydraulic jars differ from the bumper jar in that each contains a triggering mechanism which prevents impacting each other until a sufficient axial strain, either tensile or compressive, has been applied to the jar. To provide an upward jarring force, the drill pipe is stretched by an axial tensile load applied at the surface. This tensile force is resisted by the triggering mechanism of the jar long enough to allow the string to stretch and store potential energy. When the jar triggers, this stored energy is converted to kinetic energy causing the impact surfaces of the jar to move together at a relatively high velocity. To provide a downward jarring force, the pipe weight is slacked off at the surface and, and in some cases, additional compressive force is applied, to place the string in compression. This compressive force is resisted by the triggering mechanism of the jar to allow the string to compress and store potential energy. When the jar triggers, the potential energy is converted to kinetic energy causing the impact surfaces of the jar to come together at a relatively high velocity.

The triggering mechanism in most mechanical jars consists of a friction sleeve coupled to the mandrel which prevents movement of the mandrel relative to the housing until the load applied to the mandrel exceeds a preselected amount, often referred to as the "triggering load." The triggering mechanism in most hydraulic jars consists of one or more pistons which pressurize fluid in a chamber in response to movement by the mandrel relative to the housing. The compressed fluid resists movement of the mandrel. The pressurized fluid is ordinarily allowed to bleed off at a preselected rate. As the fluid bleeds off, the mandrel slowly translates relative to the housing, eventually reaching a point in the jar where the chamber seal is opened, and the compressed fluid is allowed to rush past the piston, thereby allowing the mandrel to move rapidly.

Mechanical-hydraulic jars ordinarily combine some features of both purely mechanical and purely hydraulic jars. For example, one design utilizes both a slowly metered fluid and a mechanical spring element to resist relative axial movement of the mandrel and the housing. Another design utilizes a combination of a slowly metered fluid and a mechanical brake to retard the relative movement between the mandrel and the housing. In this design, drilling mud is used as the hydraulic medium. Therefore, the string must be pressurized before the jar will operate. This pressurization step will ordinarily require a work stoppage and the insertion of a ball into the work string to act as a sealing device. After the jar is triggered, the ball must be retrieved before normal operations can continue.

In many wireline retrieval operations, particularly tight hole operations, it is often desirable to applying a tensile load on the wireline in an attempt to free the stuck downhole object without firing the jar. For example, the operator may slowly increase tension on the wireline, and then hold the tension for an extended period of time to try and dislodge the downhole assembly without the need for triggering the jar. In some cases, the operator may choose apply an overload tension in excess of the triggering load of the jar to try and dislodge the downhole assembly, but not want to fire the jar. However, with most conventional jars, application of a tensile load over a long period of time and application of an overload tension are likely to cause the jar to inadvertently fire or be very near the point of firing.

Accordingly, there remains a need in the art for downhole jars and associated devices that allow the jar triggering load to be exceeded for a finite period of time without causing the jar to fire. Such jars and associated devices would be particularly well-received if they provided the operator the option of reducing the line tension shortly after the overpull to avoid jarring, or maintaining the overpull to fire the jar.

BRIEF SUMMARY OF THE DISCLOSURE

These and other needs in the art are addressed in one embodiment by a jar having a longitudinal axis. In an embodiment, the jar comprises a housing including an anvil. In addition, the jar comprises a mandrel telescopically disposed within the housing and including a hammer. Further, the jar comprises an annular chamber radially positioned between the mandrel and the housing. Still further, the jar comprises an actuation assembly disposed in the annular chamber. The actuation assembly includes a first collet disposed about the mandrel and adapted to releasably engage the mandrel. The first collet is axially moveable between a neutral position engaging the mandrel and a triggered position disengaged from the mandrel. The actuation assembly also includes a first trigger sleeve disposed about the first collet and adapted to releasably engage the first collet. Still further, the actuation assembly includes a first biasing member adapted to exert an axial force on the mandrel upon compression of the first biasing member by movement of the mandrel in a first axial direction relative to the housing when the first collet is in the neutral position. Moreover, the jar comprises a lock assembly disposed in the annular chamber. The lock assembly includes a second collet disposed about the mandrel and adapted to releasably engage the mandrel. The second collet is axially moveable between a neutral position engaging the mandrel and a triggered position disengaged from the mandrel. The lock assembly also includes a second trigger sleeve disposed about the second collet and adapted to releasably engage the second collet. Further, the lock assembly includes a second biasing member adapted to exert an axial force on the mandrel upon compression of the second biasing member by movement of the mandrel in the first axial direction relative to the housing when the second collet is in the neutral position. The lock assembly is adapted to release the mandrel, and the actuation assembly is adapted to release the mandrel and allow to the hammer to axially impact the anvil.

These and other needs in the art are addressed in another embodiment by a jar having a longitudinal axis. In an embodiment, the jar comprises a housing including an anvil surface. In addition, the jar comprises a mandrel telescopically disposed within the housing and including a hammer surface. Further, the jar comprises a seal assembly radially disposed between the housing and the mandrel. Still further, the jar comprises an annular hydraulic chamber radially positioned between the mandrel and the housing and extending axially from the seal assembly to an annular balancing piston disposed about the mandrel. Moreover, the jar comprises an annular actuation piston disposed in the hydraulic chamber and axially positioned between the seal assembly and the balance piston. The jar also includes a first biasing member disposed in the hydraulic chamber and axially positioned between the actuation piston and a first annular shoulder on the housing. The first biasing member biases the actuation piston in a first axial direction. In addition, the jar includes a first trigger sleeve disposed in the hydraulic chamber about the mandrel. Further, the jar includes a first collet disposed in the hydraulic chamber about the mandrel. The first collet has a first position positively engaging the mandrel and the second position positively engaging the first trigger sleeve. The first collet and the actuation piston are adapted to move with the mandrel relative to the housing and the first trigger sleeve when the first collet is in the first position, and the mandrel is adapted to move relative to the first collet and the actuation piston when the first collet is in the second position. Still further, the jar includes a second trigger sleeve disposed in the hydraulic chamber about the mandrel. Moreover, the jar includes a second collet disposed in the hydraulic chamber about the mandrel. The second collet has a first position positively engaging the mandrel and the second position positively engaging the second trigger sleeve. The jar also includes a second biasing member axially positioned between a second annular shoulder on the housing and the second collet. The second collet is adapted to move with the mandrel relative to the housing and the second trigger sleeve when the second collet is in the first position, and the mandrel is adapted to move relative to the second collet when the second collet is in the second position.

These and other needs in the art are addressed in another embodiment by a method of operating a downhole jar. The jar including a housing with a longitudinal axis and a mandrel telescopically disposed within the housing. In an embodiment, the method comprises (a) applying a tensile load to the jar so as to move the mandrel relative to the housing in a first axial direction. In addition, the method comprises (b) compressing a first biasing member that biases the mandrel in a second axial direction that is opposite the first axial direction with a first biasing force. Further, the method comprises (c) removing the first biasing force from the mandrel after sufficient axial movement of the mandrel relative to the housing. Still further, the method comprises (d) continuing to apply a tensile load to the jar so as to move the mandrel relative to the housing after (c). Moreover, the method comprises (e) compressing a second biasing member that biasing the mandrel in the second axial direction with a second biasing force during (d).

Thus, embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF SOME OF THE PREFERRED EMBODIMENTS

Figure 1:
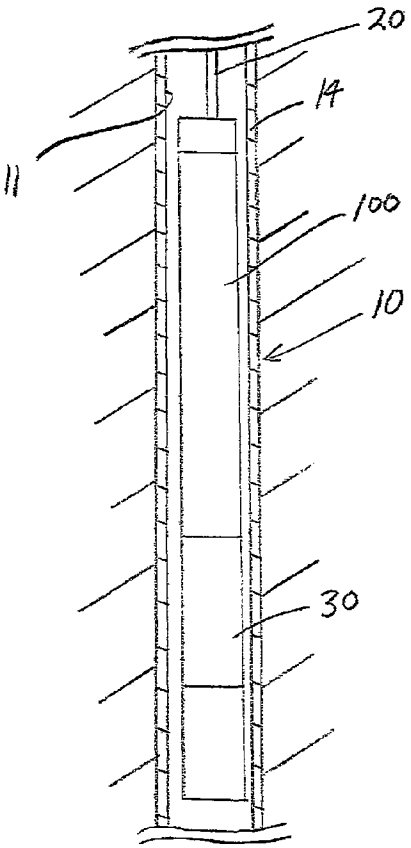
FIG. 1 is a schematic view of a downhole assembly including an embodiment of a jar in accordance with the principles described herein.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Referring now to FIG. 1, a downhole assembly 10 is shown disposed in a borehole 11 extending through an earthen formation. Borehole 11 includes casing 14 that extends downhole from the surface. In this embodiment, assembly 10 is lowered downhole with a wireline tool string 20 extending through casing 14. However, in general, the downhole assembly (e.g., assembly 10) may be run downhole by any suitable means including, without limitation, a pipe string, a drill string, a sucker rod, or other suitable device. Assembly 10 includes one or more downhole tools 30 for performing downhole operations. In general, tools 30 may include any suitable tool(s) for performing downhole operations including, without limitation, formation testing tools, perforation equipment, fracturing tools, fishing tools, etc.

As may be necessary to traverse particular producing formations, borehole 11 may include generally straight sections and curved sections. In reality, both straight and curved sections may include various kinks and twists, which generally increase the probability of assembly 10 becoming stuck downhole. Consequently, in this embodiment, a jar 100 is included in assembly 10. As will be described in more detail below, in the event assembly 10 becomes stuck in borehole 11, jar 100 may be triggered or fired to provide an abrupt, axial force sufficient to dislodge assembly 10. Although FIG. 1 shows jar 100 suspended in borehole 10 with wireline 20, in general, jar 100 may be inserted into a well borehole by any suitable means including, without limitation, via a pipestring, tubing string, drillstring, or cable string as desired.

Referring now to FIGS. 2A-2D, an exemplary embodiment of jar 100 is shown. Due to the length of jar 100, it is illustrated in four longitudinally broken sectional views, vis-à-vis FIGS. 2A, 2B, 2C and 2D. The sections are arranged in sequential order moving along jar 100 from FIG. 2A to FIG. 2D. FIGS. 2A-2D show jar 100 is a neutral or unfired position. FIGS. 8A-8D, which will be discussed in more detail below, show jar 100 in the fired position.

Jar 100 has a central or longitudinal axis 105, a first or upper end 100*a*, and a second or lower end 100*b* opposite end 100*a*. As indicated by the relative terms "upper" and "lower," jar 100 is configured to be positioned in the borehole with end 100*a* uphole of end 100*b*. In this embodiment, jar 100 includes a radially inner tubular mandrel 110 telescopically disposed within a radially outer tubular housing 210. Mandrel 110 and housing 210 are coaxially aligned such that each has a central axis coincident with jar axis 105.

Figure 2A:
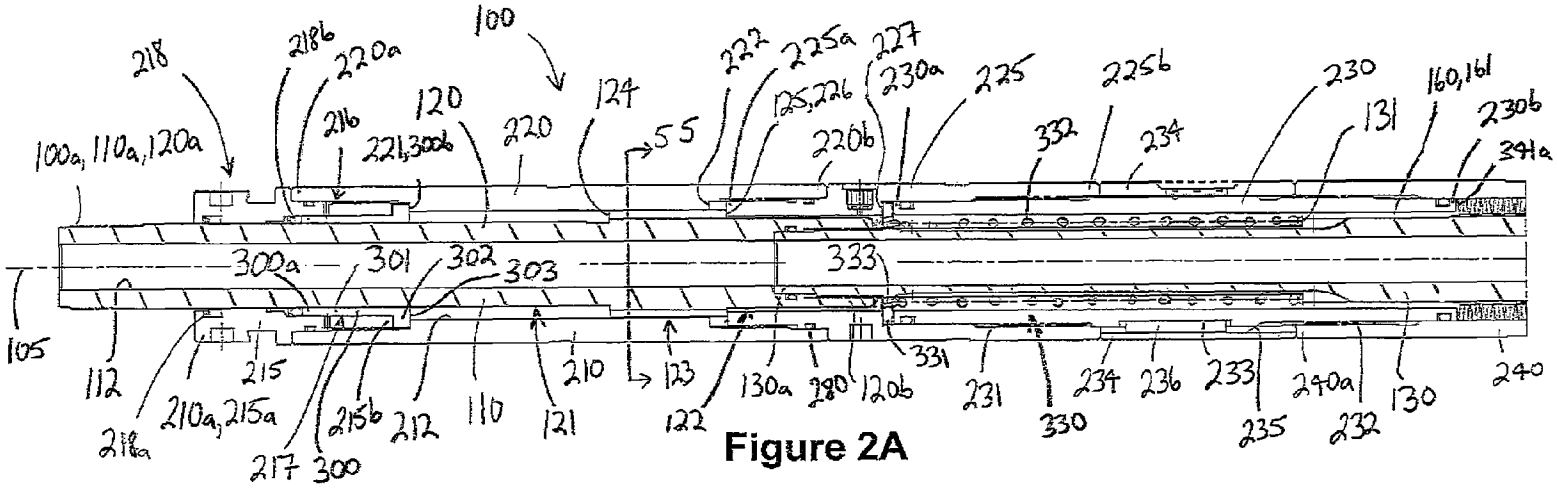
FIGS. 2A-2D are cross-sectional views of successive portions of the jar of FIG. 1 in its neutral position.
Figure 2B:
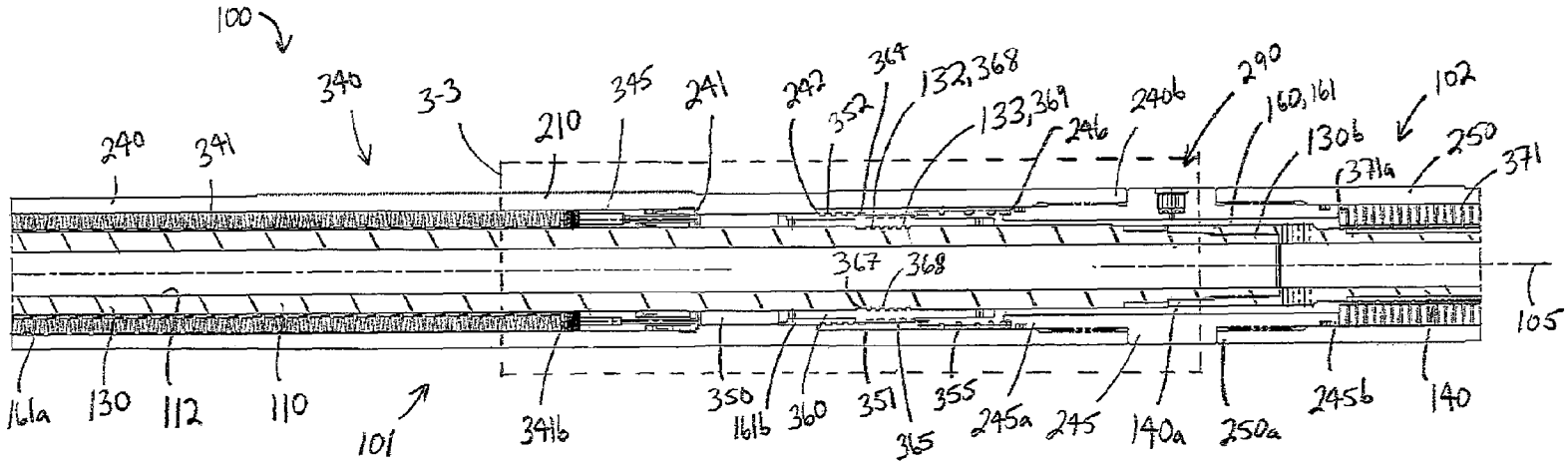
Figure 2C:
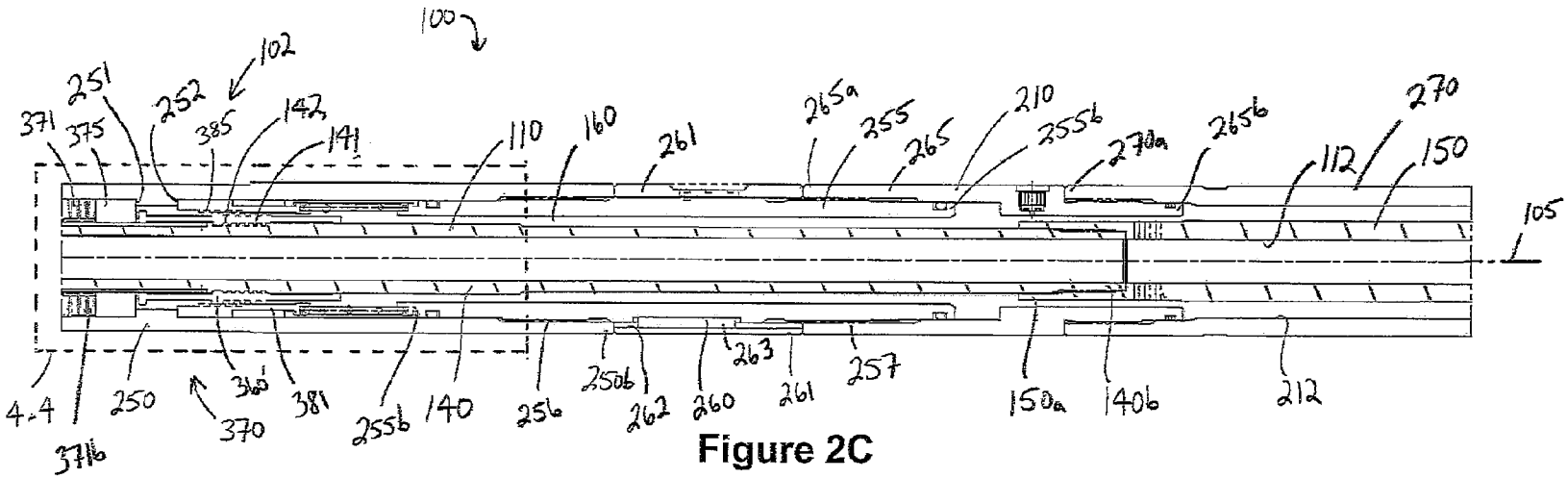
Figure 2D:
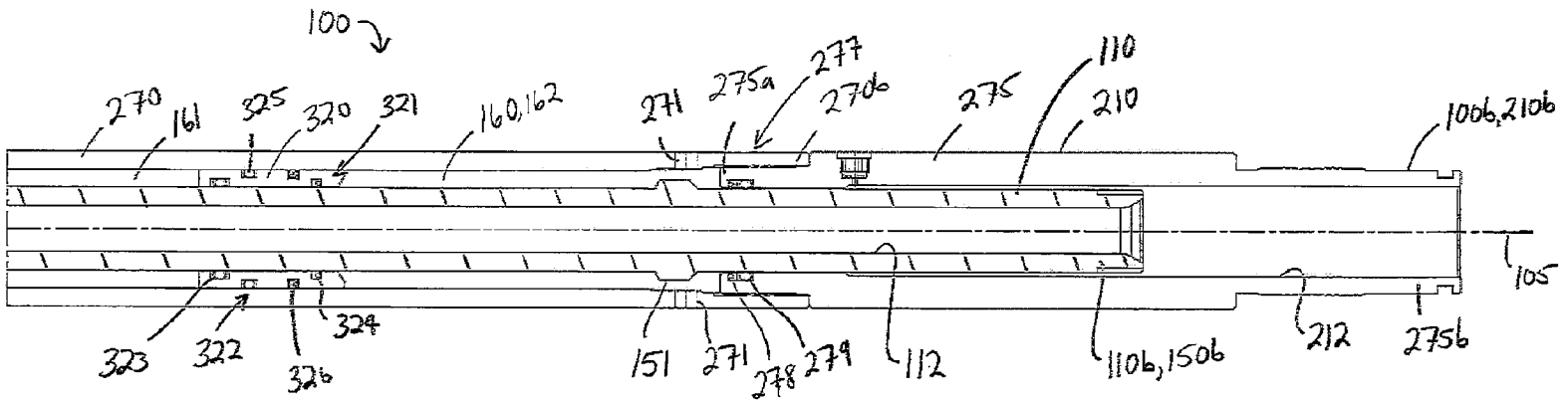

Referring still to FIGS. 2A-2D, mandrel 110 has a first or upper end 110*a* defining jar end 100*a* (FIG. 2A), and a second or lower end 110*b* opposite end 110*a* and disposed within housing 210 proximal jar lower end 100*b* (FIG. 2D). In addition, mandrel 110 has a longitudinal throughbore 112 extending axially between ends 110*a, b*. One or more electrical conducts (e.g., cables, wires, etc.) may extend through bore 112 to provide power and/or communicate signals across jar 100. In this embodiment, mandrel 110 is formed from a plurality of tubular segments joined together end-to-end with mating box-pin end threaded connections. In particular, moving axially from upper end 110*a* to lower end 110*b*, mandrel 110 includes an upper tubular member 120 (FIG. 2A), a first intermediate tubular member 130 threadably coupled to upper tubular member 120 (FIGS. 2A and 2B), a second intermediate tubular member 140 threadably coupled to first intermediate tubular member 130 (FIGS. 2B and 2C), and a lower tubular member 150 threadably coupled to second intermediate tubular member 140 (FIGS. 2C and 2D).

As best shown in FIG. 2A, upper tubular member 120 has a first or upper end 120*a* defining jar upper end 100*a*, and a second or lower end 120*b* disposed within housing 210. In this embodiment, upper end 120*a* comprises a pin end that is threadably received by a mating box end (not shown) of a connector sub or other downhole tool, coupling, or fitting, and lower end 120*b* comprises a box end that receives first intermediate tubular member 130. Upper tubular member 120 may be divided into three axial sections based on its outer diameter. Specifically, upper tubular member 120 includes a first reduced outer diameter portion 121 extending axially from end 120*a*, a second reduced outer diameter portion 122 extending axially from end 120*b*, and an enlarged outer diameter portion 123 axially disposed between portions 121, 122. As a result, the radially outer surface of upper tubular member 120 includes an annular hammer shoulder or surface 124 at the intersection of portions 121, 123, and an annular seating shoulder or surface 125 at the intersection of portions 122, 123. As will be described in more detail below, when jar 100 is triggered to fire, mandrel 110 moves axially upward relative to housing 210 at a relatively high velocity and hammer shoulder 124 impacts a mating surface in housing 110 to provide a substantial upward axial jarring force; and when jar 100 is in the neutral, unfired position, seating shoulder 125 is seated against a mating surface in housing 110.

Figure 3:
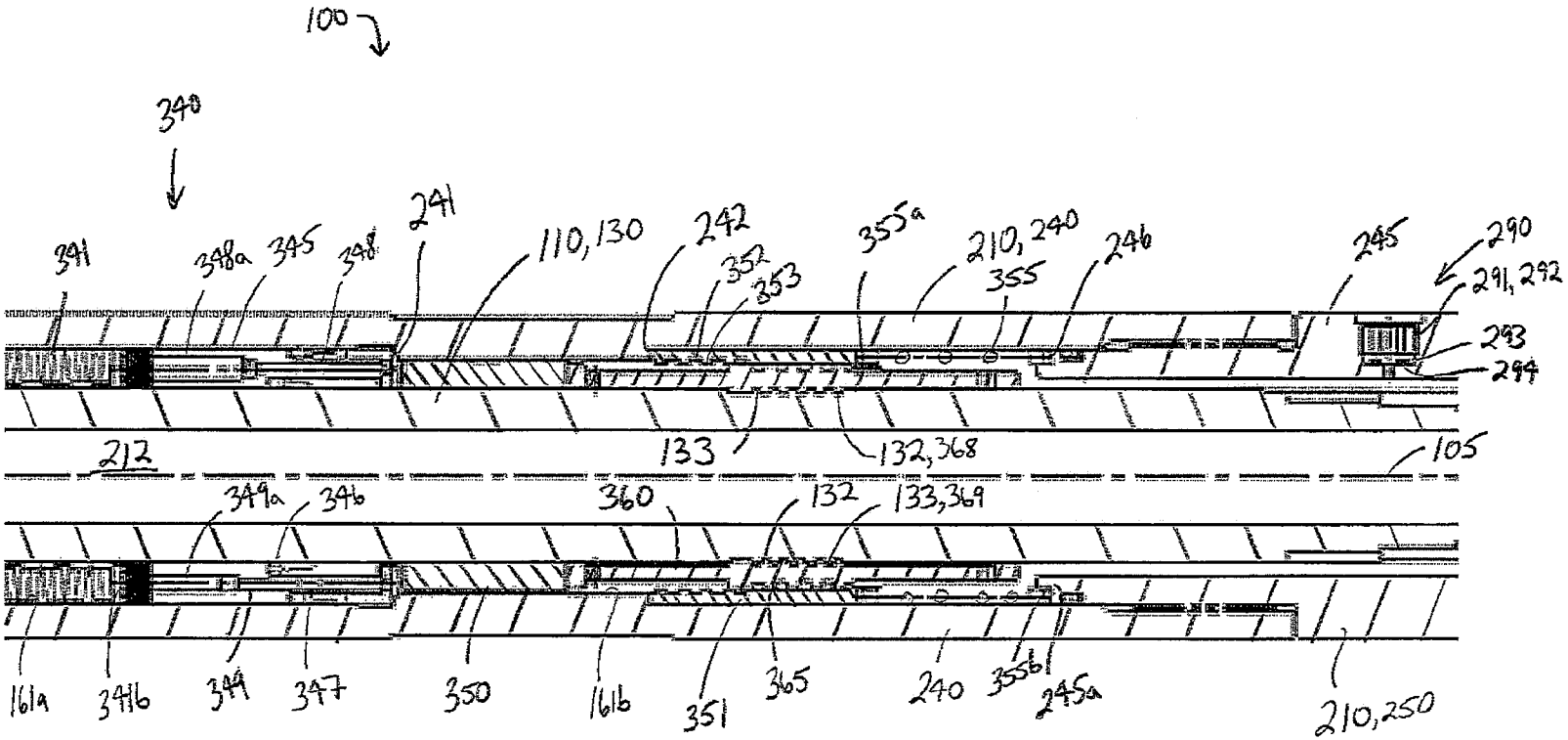
FIG. 3 is an enlarged view of the jar of FIGS. 2A-2D taken within section 3-3 of FIG. 2B.

Referring now to FIGS. 2A and 2B, first intermediate tubular member 130 has a first or upper end 130*a* and a second or lower end 130*b* opposite upper end 130*a*. In this embodiment, upper end 130*a* comprises a pin end coaxially received by box end 120*b* of upper tubular member 120, and lower end 130*b* comprises a pin end coaxially received by second intermediate tubular member 140. In addition, the radially outer surface of first intermediate tubular member 130 includes an annular shoulder 131 as best shown in FIG. 2A, and as best shown in FIGS. 2B and 3, a plurality of axially spaced annular recesses or grooves 132 defining a plurality of annular flanges 133—one flange 133 is axially disposed between each pair of axially adjacent grooves 132.

Figure 4:
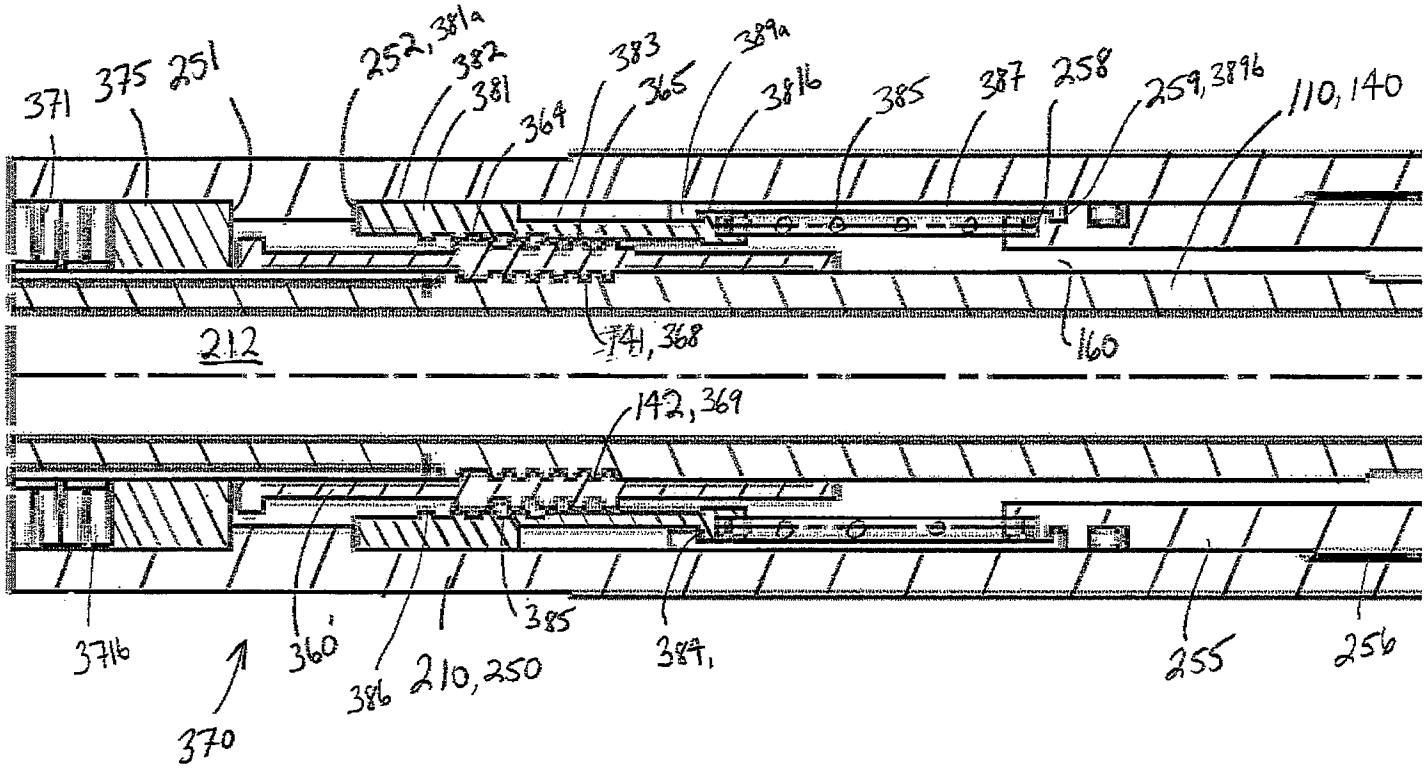
FIG. 4 is an enlarged view of the jar of FIGS. 2A-2D taken within section 4-4 of FIG. 2C.

Referring now to FIGS. 2B and 2C, second intermediate tubular member 140 has a first or upper end 140*a* and a second or lower end 140*b* opposite end 140*a*. In this embodiment, upper end 140*a* comprises a box end that receives pin end 130*b*, and lower end 140*b* comprises a pin end coaxially received by lower tubular member 150. As best shown in FIGS. 2C and 4, the radially outer surface of second intermediate tubular member 140 includes a plurality of axially spaced annular recesses or grooves 141 defining a plurality of annular flanges 142—one flange 142 is axially disposed between each pair of axially adjacent grooves 141.

Moving now to FIGS. 2C and 2D, lower tubular member 150 has a first or upper end 150*a* and a second or lower end 150*b* opposite end 150*a*. In this embodiment, upper end 150*a* comprises a box end that receives pin end 140*b*, and lower end 150*b* is a free end disposed within housing 210. In addition, the radially outer surface of lower tubular member 150 includes an annular flange 151 that is employed to prevent jar 100 from "gas locking." Methods for preventing jars from gas locking with use of an annular flange such as flange 151 are disclosed in U.S. Pat. No. 7,290,604, which is hereby incorporated herein by reference in its entirety for all purposes.

Referring again to FIGS. 2A-2D, housing 210 has a first or upper end 210*a* disposed about mandrel 110 proximal jar upper end 100*a* (FIG. 2A) and a second or lower end 210*b* defining jar lower end 100*b* (FIG. 2D). Housing upper end 210*a* is axially spaced below mandrel upper end 110*a* and housing lower end 210*b* is axially spaced below mandrel lower end 110*b*. In addition, housing 210 has a longitudinal throughbore 212 extending axially between ends 210*a, b*.

Similar to mandrel 110, housing 210 is formed from a plurality of tubular segments joined together end-to-end with mating box-pin end threaded connections. In particular, moving axially from housing upper end 210*a* to housing lower end 210*b*, housing 210 includes an upper tubular member 215 (FIG. 2A), a first intermediate tubular member 220 threadably coupled to upper tubular member 215 (FIG. 2A), a second intermediate tubular member 225 threadably coupled to first intermediate tubular member 220 (FIG. 2A), a preload adjustment tubular mandrel 230 threadably coupled to tubular member 225 (FIG. 2A), a third intermediate tubular member 240 threadably coupled to tubular mandrel 230 (FIGS. 2A and 2B), a fourth intermediate tubular member 245 threadably coupled to tubular member 240 (FIG. 2B), a fifth intermediate tubular member 250 threadably coupled to tubular member 245 (FIGS. 2B and 2C), a metering adjustment tubular mandrel 255 threadably coupled to tubular member 250 (FIG. 2C), a sixth intermediate tubular member 265 threadably coupled to tubular mandrel 255 (FIG. 2C), a seventh intermediate tubular member 270 threadably coupled to tubular member 265 (FIGS. 2C and 2D), and a bottom tubular member 275 threadably coupled to tubular member 270 (FIG. 2D).

Referring now to FIG. 2A, upper tubular member 215 has a first or upper end 215*a* and a second or lower end 215*b* opposite end 215*a*. In this embodiment, lower end 215*b* comprises a pin end that is coaxially received by first intermediate tubular member 220. In addition, upper tubular member 215 includes a reduced outer diameter portion 216 extending axially from end 215*b* and a counterbore 217 extending axially from end 215*b*.

Housing upper tubular member 215 sealingly engages mandrel 110. In particular, tubular member 215 includes a seal assembly 218 that forms dynamic seals with mandrel upper tubular member 120. Seal assembly 218 is radially disposed between tubular members 120, 215, and in this embodiment, comprises a loaded lip seal 218*a* and an O-ring seal 218*b* positioned axially below lip seal 218.

Referring still to FIG. 2A, first intermediate tubular member 220 has a first or upper end 220*a* and a second or lower end 220*b* opposite end 220*a*. In this embodiment, upper end 220*a* comprises a box end that receives pin end 215*b* and lower end 220*b* comprises a box end that receives second intermediate tubular member 225. The radially inner surface of first intermediate tubular member 220 includes an annular shoulder 221 proximal upper end 220*a* and a radially inner shoulder 222 proximal lower end 220*b*.

An anvil sleeve 300 is disposed about mandrel upper tubular member 120 and extends coaxially into counterbore 217. Specifically, sleeve 300 has a first or upper end 300*a* and a second or lower end 300*b* opposite upper end 300*a*. In this embodiment, sleeve 300 includes a cylindrical portion 301 extending axially from upper end 300*a* and an annular flange 202 extending radially outward from cylindrical portion 301 at end 300*b*. Cylindrical portion 301 is disposed in counterbore 217 and flange 302 extends radially outward along lower end 215*b*. In particular, flange 302 is axially disposed between and engages lower end 215*b* and shoulder 221. Thus, lower end 215*b* and shoulder 221 restrict sleeve 300 from moving axially relative to housing 210. Anvil sleeve flange 302 defines a downwardly facing annular anvil surface 303 that is impacted by hammer surface 124 of mandrel upper tubular member 120 to generate an upward axial jarring force when jar 100 is fired.

Figure 5:
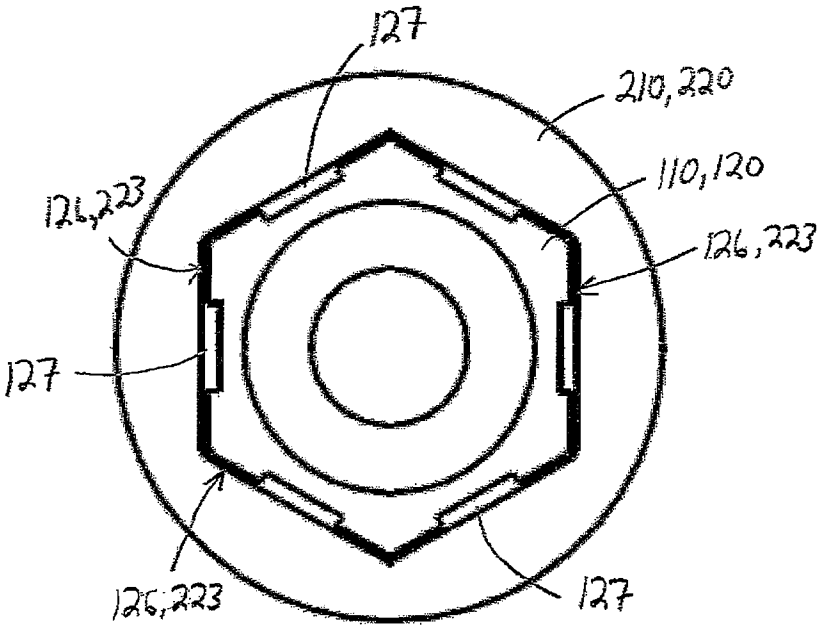
FIG. 5 is a cross-sectional view of the jar of FIG. 1 taken along section 5-5 of FIG. 2A.

Referring briefly to FIGS. 2A and 5, the radially inner surface of intermediate tubular member 220 is provided with a plurality of circumferentially spaced flats 223 extending axially between shoulders 221, 222. Flats 223 slidingly engage a plurality of mating external flats 126 on the radially outer surface of mandrel enlarged outer diameter portion 123. Flats 126, 223 permit mandrel 110 to move axially relative to housing 210, but prevent mandrel 110 from rotating about axis 105 relative to housing 210. A plurality of elongate recesses 127 are formed in one or more mandrel flats 126. Each recess 127 extends axially between mandrel shoulders 124, 125, and forms a flow passage that allows fluid to move axially across mandrel enlarged outer diameter portion 123.

Referring again to FIG. 2A, second intermediate tubular member 225 has a first or upper end 225*a* and a second or lower end 225*b* opposite end 225*a*. In this embodiment, upper end 225*a* comprises a pin end received by first intermediate tubular member 220 and lower end 225*b* comprises a box end that receives tubular mandrel 230. Upper end 225*a* defines an annular seating shoulder 226 on the radially inner surface of housing 210 against which mandrel seating shoulder 125 of enlarged diameter portion 123 seats when jar 100 is in the neutral position shown in FIGS. 2A-2D. Engagement of shoulders 125, 226 determines the lower limit of downward axial movement of mandrel 110 relative to housing 210. Further, the radially inner surface of second intermediate tubular member 225 includes an annular shoulder 227.

Referring still to FIG. 2A, preload adjustment tubular mandrel 230 has a first or upper end 230*a* and a second or lower end 230*b* opposite end 230*a*. In this embodiment, upper end 230*a* comprises a pin end received by box end 225*b*, and lower end 230*b* comprises a pin end received by third intermediate tubular member 240. The radially outer surface of mandrel 230 includes external threads 231 proximal upper end 230*a*, external threads 232 proximal lower end 230*b*, and an elongate recess or slot 233 axially positioned between threads 231, 231. Slot 233 is oriented parallel to axis 105. In other words, slot 233 extends axially along mandrel 230. In this embodiment, threads 231, 232 are oppositely threaded, and thus, if threads 231 are right-hand threads, then threads 232 are left-hand threads, and if threads 231 are left-hand threads, then threads 232 are right-hand threads. An adjustment ring 234 is disposed about mandrel 230 and over slot 233. The radially inner surface of ring 234 includes an elongate recess or slot 235 circumferentially aligned with mandrel slot 233. A key 236 is radially disposed between mandrel 230 and ring 234, and slidingly engages both axially extending slots 233, 235. Key 236 has an axial length less than the axial length of each slot 233, 235. Thus, key 236 allows mandrel 230 to move axially relative to ring 234, but prevents mandrel 230 from moving rotationally about axis 105 relative to ring 234. Accordingly, rotation of ring 234 about axis 105 results in the rotation of mandrel 230 about axis 105 in the same direction. Since external threads 231, 232 are oppositely threaded, rotation of ring 234 and mandrel 230 about axis 105 in a first direction results in the axial translation of mandrel 230 relative to ring 234, second intermediate tubular member 225, and third intermediate tubular member 240.

Referring now to FIGS. 2A and 2B, third intermediate tubular member 240 has a first or upper end 240*a* and a second or lower end 240*b* opposite end 240*a*. In this embodiment, upper end 240*a* comprises a box end that receives pin end 230*b* and lower end 240*b* comprises a box end that receives fourth intermediate tubular member 245. The radially inner surface of third intermediate tubular member 240 includes an annular shoulder 241 proximal lower end 240*b* and an annular shoulder 242 axially positioned between shoulder 241 and end 240*b*.

Referring to FIGS. 2B and 3, fourth intermediate tubular member 245 has a first or upper end 245*a* and a second or lower end 245*b* opposite end 245*a*. In this embodiment, upper end 245*a* comprises a pin end received by box end 240*b* and lower end 245*b* comprises a pin end received by fourth intermediate tubular member 250. Further, the radially outer surface of tubular member 245 includes an annular groove or recess 246 extending axially from end 245*a*.

Referring now to FIGS. 2B, 2C, and 3, fifth intermediate tubular member 250 has a first or upper end 250*a* and a second or lower end 250*b* opposite end 250*a*. In this embodiment, upper end 250*a* comprises a box end that receives pin end 245*b* and lower end 250*b* comprises a box end that receives tubular mandrel 255. The radially inner surface of tubular member 250 includes an annular shoulder 251 proximal lower end 250*b* and an annular shoulder 252 axially disposed between shoulder 251 and end 250*b*.

Referring now to FIGS. 2C and 4, tubular mandrel 255 has a first or upper end 255*a* and a second or lower end 255*b* opposite end 255*a*. Further, upper end 255*a* comprises a pin end received by box end 250*b*, and lower end 255*b* comprises a pin end received by sixth intermediate tubular member 265. The radially outer surface of mandrel 255 includes external threads 256 proximal upper end 255*a*, external threads 257 proximal lower end 255*b*, an annular recess 258 extending axially from end 255*a*, an annular recess or groove 259 axially disposed between threads 256 and end 255*a*, and an elongate recess or slot 260 axially positioned between threads 256, 257. Slot 260 is oriented parallel to axis 105. In other words, slot 260 extends axially along mandrel 255. Threads 256, 257 are oppositely threaded, and thus, if threads 256 are right-hand threads, then threads 257 are left-hand threads, and if threads 256 are left-hand threads, then threads 257 are right-hand threads. An adjustment ring 261 is disposed about mandrel 255 and over slot 260. The radially inner surface of ring 261 includes an elongate recess or slot 262 circumferentially aligned with mandrel slot 260. A key 263 is radially disposed between mandrel 255 and ring 261, and slidingly engages both axially extending slots 260, 262. Key 263 has an axial length less than the axial length of each slot 260, 262. Thus, key 263 allows mandrel 255 to move axially relative to ring 261, but prevents mandrel 255 from moving rotationally about axis 105 relative to ring 261. Accordingly, rotation of ring 261 about axis 105 results in the rotation of mandrel 255 about axis 105 in the same direction. Since external threads 256, 257 are oppositely threaded, rotation of ring 258 and mandrel 255 about axis 105 in a first direction results in the axial translation of mandrel 255 relative to ring 261, fifth intermediate tubular member 250, and sixth intermediate tubular member 265.

Referring to FIGS. 2C and 2D, sixth intermediate tubular member 265 has a first or upper end 265*a* and a second or lower end 265*b* opposite end 265*a*. In this embodiment, upper end 265*a* comprises a box end that receives pin end 255*b* and lower end 265*b* comprises a pin end received by seventh intermediate tubular member 270. Seventh intermediate tubular member 270 has a first or upper end 270*a* and a second or lower end 270*b* opposite end 270*a*. In this embodiment, upper end 270*a* comprises a box end that receives pin end 265*b* and lower end 270*b* comprises a box end that receives bottom tubular member 275. A plurality of ports 271 extend radially through tubular member 270 proximal lower end 270*b*.

Referring to FIG. 2D, bottom tubular member 275 has a first or upper end 275*a* and a second or lower end 275*b* opposite end 275*a*. In this embodiment, upper end 275*a* comprises a pin end received by box end 270*b* and lower end 275*b* comprises a pin end that is threadably received by a mating box end (not shown) of a connector sub or other downhole tool, coupling, or fitting. Housing bottom tubular member 275 sealingly engages mandrel 110. In particular, tubular member 275 includes a seal assembly 277 that forms dynamic seals with mandrel lower tubular member 150. Seal assembly 277 is radially disposed between tubular members 150, 275, and in this embodiment, comprises a loaded lip seal 278 and an O-ring seal 279 positioned axially below lip seal 278.

Referring again to FIGS. 2A-2D, housing upper tubular member 215 and housing lower tubular member 275 each sealingly engage mandrel 110. However, axially between seal assemblies 218, 277, housing 210 is radially spaced apart from mandrel 110. In particular, an annulus 160 is generally defined by the open internal spaces radially disposed between mandrel 110 and housing 210. As best shown in FIG. 2D, an annular pressure equalizing or balance piston 320 is disposed in annulus 160 and divides annulus 160 into an annular operating or working fluid chamber 161 extending axially from upper seal assembly 218 to piston 320 and an annular fluid chamber 162 extending axially from lower seal assembly 277 to piston 320. Fluid chamber 161 above piston 320 is filled with operating or working fluid and is generally permitted to flow axially back and forth within chamber 161 between and around the various components disposed within chamber 161. The working fluid is preferably a hydraulic fluid, light oil or the like. Fluid chamber 162 below the piston 320 is vented to the wellbore annulus by ports 271 in housing intermediate tubular member 270.

Piston 320 is designed to ensure that the pressure of the operating fluid within chamber 161 is substantially the same as the fluid pressure in the wellbore annulus, while simultaneously restricting and/or preventing fluid communication between chambers 161, 162. Accordingly, piston 320 includes a radially inner seal assembly 321 that sealingly engages mandrel 110 and a radially outer seal assembly 322 that sealingly engages housing 210. In this embodiment, inner seal assembly 321 includes an O-ring seal 323 and a loaded lip seal 324 axially spaced below O-ring seal 323, and similarly, outer seal assembly 322 includes an O-ring seal 325 and a loaded lip seal 326 axially spaced below O-ring seal 325. Thus, housing seal assembly 218 and piston seal assemblies 321, 322 restrict and/or prevent mud and other debris in the wellbore annulus from contaminating the operating fluid (e.g., hydraulic fluid) within chamber 161, and restrict and/or prevent the loss of operating fluid from chamber 161 into the wellbore annulus.

Referring still to FIGS. 2A-2D and 3, working fluid may be added or removed from chamber 161 via one or more fill ports 290 provided in housing 210. A fluid plug 291 is removably disposed within and closes off each fill port 290. Access to chamber 161 may be achieved by removing any fluid plug 291 from its corresponding fill port 290. In this embodiment, each fluid plug 281 comprises an externally threaded hex nut 292 that compresses a sealed disk 293 provided with an O-ring seal 294.

Figure 8A:
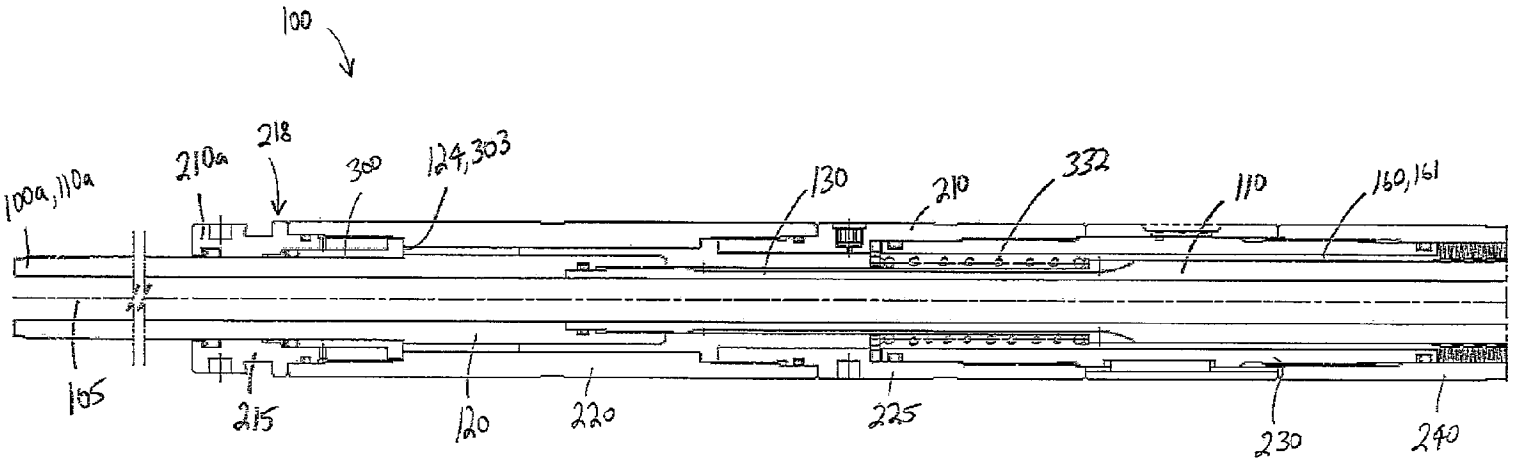
FIGS. 8A-8D are cross-sectional views of successive portions of the jar of FIG. 1 in its fired position.

As will be described in more detail below and is shown in FIG. 8A, when jar 100 is triggered, mandrel 110 moves axially upward relative to housing 210 at a relatively high velocity until mandrel hammer surface 124 impacts anvil surface 303 to generate an upward axial jarring force. To reset jar 100 such that it may be fired again (i.e., to transition jar 100 from the fired position shown in FIGS. 8A-8D to the neutral position shown in FIGS. 2A-2D), mandrel 110 is moved axially downward relative to housing 210 until mandrel seating shoulder 125 axially abuts housing seating shoulder 226. To aid in resetting jar 100, particularly in highly deviated boreholes or situations with high wall drag, jar 100 includes a recocking assembly 330 disposed in chamber 161 and axially positioned between housing annular shoulder 227 and mandrel annular shoulder 131. As best shown in FIG. 2A, in this embodiment, recocking assembly 330 includes a washer 331 and a recocking spring 332. Washer 331 is disposed about mandrel 110 and axially abuts housing shoulder 227. Washer 331 is held in engagement with housing shoulder 227 by spring 332, which extends axially between washer 331 and mandrel shoulder 131. Specifically, spring 332 is compressed between washer 331 and mandrel shoulder 131, and thus, urges washer 331 into engagement with housing shoulder 227, urges mandrel shoulder 227 axially away from housing shoulder 227, and urges mandrel seating shoulder 125 into engagement with housing seating shoulder 226. Washer 331 includes a plurality of circumferentially spaced bores 333 extending axially through washer 331. Bores 333 allow working fluid in chamber 161 to flow freely across washer 331.

Referring now to FIGS. 2A and 2B, in this embodiment, jar 100 includes a firing section 101 and a releasable lock section 102. Firing section 101 is generally disposed between jar upper end 100*a* and housing intermediate tubular member 245, and lock section 102 is generally disposed between jar lower end 100*b* and housing intermediate tubular member 245. As will be described in more detail below, firing section 101 is the portion of jar 100 that, when triggered, generates an axial impact force to dislodge a stuck downhole assembly. Lock section 102 is the portion of jar 100 that prevents firing section 101 from firing until lock section 102 has first been actuated.

Referring now to FIGS. 2B and 3, jar firing section 101 includes a jar actuation assembly 340 disposed within chamber 161 and axially positioned between lower end 230*b* of housing mandrel 230 and upper end 245*a* of housing tubular member 245. In this embodiment, jar actuation assembly 340 includes a biasing member 341, an annular actuation piston 345, a spacer or compression ring 350, a trigger sleeve 351, a trigger sleeve biasing member 355, and an annular collet 360.

Biasing member 341 is axially positioned between lower end 230*b* of housing mandrel 230 and actuation piston 345. In particular, biasing member 341 has a first or upper end 341*a* that bears against lower end 230*b* and a second or lower end 341*b* that bears against piston 345. In this embodiment, biasing member 341 comprises a stack of Bellville springs formed by a plurality of individual Bellville springs arranged one-adjacent-the other (e.g., one-above-the-other) to form an elongate "stack." However, in other embodiments, the piston biasing member (e.g., biasing member 341) may comprise other types of spring arrangements including, without limitation, coil springs. Biasing member 341 is configured such that it provides minimal resistance to the axial flow of working fluid. For example, biasing member 341 may be radially spaced from housing 210, radially spaced from mandrel 110, include one or more axial throughbores or flow passages, or combinations thereof.

Biasing member 341 is axially compressed between end 230*b* and piston 345, and thus, urges piston 345 axially downward and away from end 230*b*. Thus, the biasing member 341 resists upward axial movement of actuating piston 345 and seeks to seat actuating piston 345 against housing annular shoulder 241 as shown in FIG. 2B. As will be described in more detail below, biasing member 341 is compressed when jar 100 is in the neutral position, thereby providing firing section 101 with a preload that enables the operator to apply an upward axial force on mandrel 110 without necessarily firing jar 100. For example, biasing member 341 may be configured to apply a 1,000 lb. downward force on piston 345 with the jar 100 in the neutral position shown in FIGS. 2A-2D. So long as the upward axial force applied to piston 345 does not exceed this preload, firing section 101 will not fire. The amount of preload may be adjusted by varying the compression of biasing member 341 with housing tubular mandrel 230. Specifically, adjustment ring 234 and mandrel 230 may be rotated about axis 105 in a first direction to move mandrel 230 axially downward towards shoulder 241 and piston 345, thereby increasing the preload and axial compression of biasing member 341. Alternatively, adjustment ring 234 and mandrel 230 may be rotated about axis 105 in the opposite direction to move mandrel 230 axially upward away from shoulder 241 and piston 345, thereby decreasing the preload and axial compression of biasing member 341.

Referring now to FIG. 2B, actuating piston 345 is axially positioned between biasing member 341 and housing annular shoulder 241. As previously described, biasing member 341 urges piston 345 into engagement with shoulder 241. Piston 345 slidably engages mandrel 110 and housing 110. Thus, piston 345 may move axially within chamber 161 relative to mandrel 110 and/or housing 210. However, housing shoulder 241 defines the lower limit of axially downward movement of piston 345 within chamber 161, and as will be described in more detail below, the positive engagement of trigger sleeve 351 and collet 360 defines the upper limit of axially upward movement of piston 345 within chamber 161.

As best shown in FIG. 3, piston 345 includes a radially inner seal assembly 346 that sealingly engages mandrel 110 and a radially outer seal assembly 347 that sealingly engages housing 210. Seal assembly 346 restricts and/or prevents working fluid in chamber 161 from flowing axially between piston 345 and mandrel 110, and seal assembly 347 restricts and/or prevents working fluid in chamber 161 from flowing axially between piston 345 and housing 210. In this embodiment, each seal assembly 346, 347 comprises an O-ring seal.

Figure 6:
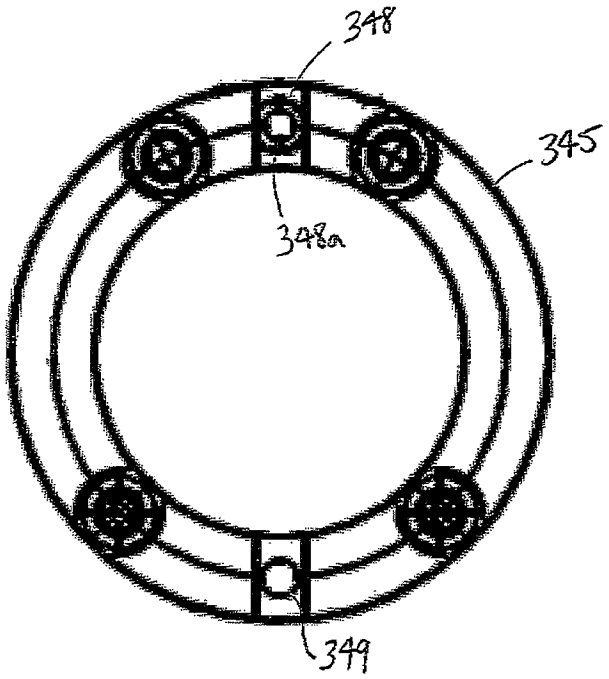
FIG. 6 is an upper, end view of the actuating piston of FIG. 2B.

Referring now to FIGS. 3 and 6, actuating piston 345 includes a first flow passage 348 and a second flow passage 349, each flow passage 348, 349 extends axially through piston 345. First flow passage 348 is designed to permit the restrictive flow of fluid axially downward through piston 345 to permit the build up of working fluid pressure in the portion of chamber 161 between seal assembly 218 and piston 345 while simultaneously permitting actuating piston 345 to move axially upwards through chamber 161 until jar 100 triggers as described more fully below. In this regard, first flow passage 348 includes a conventional flow restriction orifice 348*a*. In general, any suitable flow restriction device may be used. One example of a suitable flow restriction device is the Ø 0.187 in. (outer diameter) Visco Jet available from The Lee Company of Westbrook, Conn.

Second flow passage 349 includes a one-way check valve 349*a* that restricts and/or prevents working fluid from flowing through passage 349 when piston 345 moves axially upward within chamber 161, but allows working fluid to flow through passage 349 when piston moves axially downward within chamber 161. In general, the check valve may comprise any suitable check valve that allows one-way fluid flow. One example of a suitable check valve is the Ø 0.187 in. (outer diameter) Lee Chek check valve available from The Lee Company of Westbrook, Conn.

Actuating piston 345 divides jar working fluid chamber 161 into a first or upper portion 161*a* extending axially from seal assembly 218 to piston 345 and a second or lower portion 161*b* extending axially from piston 345 to piston 320. Since piston 345 sealingly engages mandrel 110 and housing 210, flow restriction orifice 348*a* in flow passage 348 restricts working fluid flow therethrough, and check valve 349*a* in flow passage 349 prevents working fluid flow therethrough, piston 345 substantially restricts working fluid in upper chamber portion 161*a* from flowing into lower chamber portion 161*b*. Thus, as piston 345 moves axially upward within chamber 161, the pressure of working fluid in chamber upper portion 161 increases. Such an increase in the working fluid pressure in chamber upper portion 161 resists the upward movement of piston 345. That is, upward relative movement of piston 345 relative to the housing 210 reduces the volume of chamber upper portion 161*a*, thereby causing a significant increase in the working fluid pressure within chamber upper portion 161*a* that generates an axial force that resist the upward movement of piston 345 relative to housing 210. This resistance to relative movement of piston 345 allows a large buildup of potential energy. However, over time, flow restrictor 348*a* slowly allows working fluid to flow through piston 345 from chamber upper portion 161*a* to chamber lower portion 161*b*, and thereby allows piston 345 to creep upward within chamber 161 relative to housing 210. It is this bleeding of working fluid across piston 345 as piston 345 is urged axially upward within chamber 161 that defines the hydraulic delay portion of the firing cycle of jar 100 and firing section 101. As previously described, biasing member 355 also exerts and axial force on piston 345 that resists upward movement of piston 345 relative to housing 210.

Referring to FIGS. 2B and 3, tubular trigger sleeve 351 is radially positioned between housing 210 and collet 360, and axially positioned between housing shoulder 242 and end 245*a* of housing tubular member 245. Trigger sleeve 351 slidingly engages housing 210, and thus, is generally free to move axially between shoulder 242 and tubular member end 245*a*. However, biasing member 355 is axially positioned between trigger sleeve 351 and end 245*a*. In particular, biasing member 355 has a first or upper end 355*a* that axially abuts trigger sleeve 351 and a second or lower end 355*b* that engages housing tubular member 245 and is seated in recess 246. Biasing member 355 is axially compressed between trigger sleeve 351 and end 245*a*, and thus, urges trigger sleeve 351 into engagement with housing shoulder 242. In this embodiment, biasing member 355 is a coil spring, however, in general, the trigger sleeve biasing member (e.g., biasing member 355) may comprise any suitable biasing device such as a wave spring.

Trigger sleeve 351 has a radially outer cylindrical surface that slidingly engages housing 210 and a radially inner surface that includes a plurality of annular recesses 352 defining a plurality of radially inwardly projecting annular flanges 353—one flange 353 is axially disposed between each pair of axially adjacent recesses 352. As will be described in more detail below, recesses 352 and flanges 353 are sized and configured to releasably engage a plurality of mating flanges and recesses, respectively, provided on the radially outer surface of collet 360 when jar 100 is fired.

Referring now to FIGS. 2B and 5, collet 360 is radially disposed between mandrel 110 and trigger sleeve 351, and has a first or upper end 360*a* and a second or lower end 360*b* opposite end 360*a*. In addition, collet 360 has a generally tubular body 361 including a plurality of circumferentially spaced slots 362*a* extending axially from end 360*a* and a plurality of circumferentially spaced slots 362*b* extending axially from end 360*b*. One slot 362*a* is circumferentially disposed between each pair of circumferentially adjacent slots 362*b*. Slots 362*a* divide body 361 into a plurality of elongate circumferentially spaced fingers or segments 363 extending axially from ends 360*a, b*. During the operation of jar 100, segments 363 are subjected to bending forces and stresses. Accordingly, in this embodiment, the end of each slot 362*a, b* is rounded to avoid stress concentrations.

The radially outer surface of each axially extending segment 363 includes a primary flange 364 and a plurality of secondary flanges 365 positioned between lower end 360*b* and primary flange 364. Flanges 364, 365 define a plurality of recesses or grooves 366 on the radially outer surface of each segment 363—one groove 366 is axially positioned between each pair of axially adjacent flanges 364, 365. Each flange 364, 365 extends circumferentially across its respective segment 363 and projects radially outward from body 361. On each segment 363, primary flange 364 is positioned axially above secondary flanges 365, and further, primary flange 364 has a greater axial width than each secondary flange 365. Collet flanges 364, 365 and recesses 366 are sized and configured to releasably mesh with and engage trigger sleeve recesses 352 and flanges 353, respectively. When collet flanges 364, 365 and recesses 366 positively engage trigger sleeve recesses 352 and flanges 353, respectively, collet 360 is fixed relative to trigger sleeve 351 (i.e., collet 360 does not move axially relative to trigger sleeve 351).

The radially inner surface of each axially extending segment 363 also includes a primary flange 367 and a plurality of secondary flanges 368 positioned between lower end 360*b* and primary flange 367. Flanges 367, 368 define a plurality of recesses or grooves 369 on the radially inner surface of each segment 363—one groove 369 is axially positioned between each pair of axially adjacent flanges 367, 368. Each flange 367, 368 extends circumferentially across its respective segment 363 and projects radially inward from body 361. On each segment 363, primary flange 367 is positioned axially above secondary flanges 368, and further, primary flange 367 has a greater axial width than each secondary flange 368. Collet flanges 367, 368 and recesses 369 are sized and configured to releasably mesh with and engage mandrel recesses 132 and flanges 133, respectively. When collet flanges 367, 368 and recesses 369 positively engage mandrel recesses 132 and flanges 133, respectively, collet 360 is fixed relative to mandrel 110 (i.e., collet 360 does not move axially relative to mandrel 110).

As previously described, collet flanges 367, 368 and recesses 369 releasably engage mandrel recesses 132 and flanges 133, respectively, and collet flanges 364, 365 and recesses 366 releasably engage trigger sleeve recesses 352 and flanges 353, respectively. When collet flanges 367, 368 and recesses 369 positively engage mandrel recesses 132 and flanges 133, respectively, collet 360 is secured to mandrel 110 and moves axially along with mandrel 110. However, when collet flanges 364, 365 and recesses 366 positively engage trigger sleeve recesses 352 and flanges 353, respectively, collet 360 is secured to trigger sleeve 351 and mandrel 110 is free to move axially relative to collet 360. Thus, collet 360 of actuation assembly 340 may be described as having a first position secured to mandrel 110 and a second position secured to trigger sleeve 351. Collet 360 transitions from the first position to the second position as collet flanges 364, 365 and recesses 366 come into alignment with trigger sleeve recesses 352 and flanges 353, respectively, and simultaneously move into positive engagement with trigger sleeve recesses 352 and flanges 353, respectively, and out of engagement with mandrel recesses 132 and flanges 133, respectively. Further, collet 360 transitions from the second position to the first position as collet flanges 364, 365 and recesses 366 come into alignment with mandrel recesses 132 and flanges 133, respectively, and simultaneously move into positive engagement with mandrel recesses 132 and flanges 133, respectively, and out of engagement with trigger sleeve recesses 352 and flanges 353, respectively.

As best shown in FIG. 2B, compression ring 350 is axially positioned between collet 360 and piston 345 and transfers axial forces therebetween. So long as flanges 367, 368 and recesses 369 positively engage mandrel recesses 132 and flanges 133, respectively, axial forces applied to mandrel 110 are transmitted through collet 360 to compression ring 350 and actuating piston 345. Compression ring 350 does not sealingly engage mandrel 110 or housing 210 and allows working fluid in chamber 161 to pass axially thereacross as ring 350 moves axially through chamber 161. In particular, there is a sufficient OD clearance between compression ring 350 and housing 210 to allow working fluid to bypass ring 350 with little restriction.

Referring now to FIGS. 2B, 2C, and 4, jar lock section 102 includes a lock assembly 370 disposed within chamber 161 and axially positioned between lower end 245*b* of housing tubular member 245 and upper end 255*a* of housing tubular mandrel 255. In this embodiment, lock assembly 370 includes a biasing member 371, a spacer or compression ring 375, a trigger sleeve 381, a trigger sleeve biasing member 385, and a collet 360'. Thus, in this embodiment, lock assembly 370 includes substantially the same components as actuation assembly 340 previously described, except that lock assembly 370 does not include a piston (e.g., actuation piston 345). Collet 360' of lock assembly 370 is substantially the same as collet 360 of actuation assembly 340 previously described and shown in FIG. 5, except that collet 360' has a smaller ID than collet 360 since collets 360, 360' are configured to mate with mandrel tubular members 130, 140, respectively, which have different ODs. For purposes of clarity and further explanation, collet 360' of lock assembly 370 has been denoted with a "'".

Biasing member 371 is axially positioned between lower end 245*b* of housing tubular member 245 and compression ring 375. In particular, biasing member 371 has a first or upper end 371*a* that bears against lower end 245*b* and a second or lower end 371*b* that bears against compression ring 375. Biasing member 371 is configured such that it provides minimal resistance to the axial flow of working fluid. For example, biasing member 371 may be radially spaced from housing 210, radially spaced from mandrel 110, include one or more axial throughbores or flow passages, or combinations thereof. In this embodiment, biasing member 371 comprises a stack of Bellville springs. As previously described, a "stack" of Bellville springs refers to a plurality of Bellville springs positioned one adjacent the other (e.g., one-above-the-other) to form an elongate "stack." In other embodiments, the piston biasing member (e.g., biasing member 371) may comprise other types of spring arrangements including, without limitation, coil springs.

Biasing member 371 is axially compressed between end 245*b* and ring 375, and thus, urges ring 375 axially downward and away from end 245*b*. Thus, the biasing member 371 resists upward axial movement of compression ring 375 and seeks to seat ring 375 against housing annular shoulder 251 as shown in FIGS. 2C and 4. As will be described in more detail below, biasing member 341 is compressed when jar 100 is in the neutral position, thereby providing lock section 102 with a preload that enables the operator to apply an upward axial force on mandrel 110 without necessarily actuating lock section 102. For example, biasing member 371 may be configured to apply a 5,000 lb. downward force on ring 375 and mandrel 110 with the jar 100 in the neutral position shown in FIGS. 2A-2D. So long as the upward axial force applied to compression ring 375 does not exceed this preload, lock section 102 remains in the locked position engaging mandrel 110. The amount of preload provided by biasing member 371 may be adjusted by varying the compression of biasing member 371. For example, additional Bellville springs may be added to the stack or the axial width of compression ring 375 may be increased.

The preload (e.g., lbs.) provided by each biasing member 341, 371 may be varied depending on the application and generally depends on the axial travel required to trigger collets 360, 360', respectively. In this embodiment, sections 101, 102 are configured such that biasing member 371 provides a larger preload than biasing member 341. This may be achieved, for example, by including Bellville springs in biasing member 371 with a greater axial thickness than the Bellville springs in biasing member 341 as shown in FIGS. 2A-2C, compressing biasing member 371 greater than biasing member 341 in the neutral position, or combinations thereof. In this exemplary embodiment, the preload of biasing member 341 is about 20% the preload of 371.

Referring now to FIG. 2C, compression ring 375 is axially positioned between biasing member 371 and housing annular shoulder 251. As previously described, biasing member 371 urges ring 375 into engagement with shoulder 251. Ring 375 slidingly engages housing 210 but is radially spaced from mandrel 110. Thus, ring 375 is generally free to move axially through chamber 181 relative to housing 210 and/or mandrel 110. However, housing shoulder 251 defines the lower limit of axially downward movement of ring 375 within chamber 181, and as will be described in more detail below, the positive engagement of trigger sleeve 381 and collet 360' defines the upper limit of axially upward movement of ring 375 within chamber 181.

Unlike piston 345 previously described, ring 375 does not sealingly engage housing 210 or mandrel 110. Thus, working fluid in chamber 161 is generally free to move around ring 375 (e.g., between ring 375 and mandrel 210 and between ring 375 and housing 210) as ring 375 moves axially through chamber 161. Since ring 375 is axially spaced from mandrel 110, working fluid around ring 375 will pass through the annulus between ring 375 and mandrel 110. In addition, there is a sufficient OD clearance between compression ring 375 and housing 210 to allow working fluid to flow between ring 375 and housing 210 with little restriction.

Referring to FIGS. 2C and 4, tubular trigger sleeve 381 is radially positioned between housing 210 and collet 360', and axially positioned between housing shoulder 252 and end 255*a* of housing tubular mandrel 255. Trigger sleeve 381 slidingly engages housing 210, and thus, is generally free to move axially between shoulder 252 and end 255*a*. However, biasing member 385 is axially positioned between trigger sleeve 381 and end 255*a*. In particular, biasing member 385 has a first or upper end 385*a* that axially abuts trigger sleeve 381 and a second or lower end 385*b* that engages housing tubular mandrel 255 and is seated in recess 258. Biasing member 385 is axially compressed between trigger sleeve 381 and end 255*a*, and thus, urges trigger sleeve 381 into engagement with housing shoulder 252. In this embodiment, biasing member 385 is a coil spring, however, in general, the trigger sleeve biasing member (e.g., biasing member 385) may comprise any suitable biasing device such as a wave spring.

Trigger sleeve 381 has a first or upper end 381*a* and a second or lower end 381*b* opposite end 381*a*. In addition, trigger sleeve 381 has a radially outer surface including a cylindrical portion 382 extending from end 381*a* and an annular recess 383 axially positioned between cylindrical portion 382 and end 381*b*. Recess 383 is proximal to, but does not extend to end 381*b*, and therefore, defines an annular shoulder 384 along the outer surface of trigger sleeve 381. The radially inner surface of trigger sleeve 381 includes a plurality of annular recesses 385 defining a plurality of radially inwardly projecting annular flanges 386—one flange 386 is axially disposed between each pair of axially adjacent recesses 385. Recesses 385 and flanges 386 are sized and configured to releasably engage mating flanges 364, 365 and recesses 366, respectively, provided on the radially outer surface of collet 360' as described in more detail below.

An annular split ring 387 couples trigger sleeve 381 to housing tubular mandrel 255. Split ring 387 has a radially outer cylindrical surface that slidingly engages housing 210 and a radially inner surface include an annular recess 388 that defines annular flanges 389*a*, 389*b* at the upper and lower ends, respectively, of split ring 387. Flanges 389*a*, 389*b* extend radially inward and engage recesses 383, 259, respectively, of trigger sleeve 381 and housing tubular mandrel 255, respectively. Together, adjustment ring 261, housing mandrel 255, and split ring 387 allow for the adjustment of the axial position of trigger sleeve 381 relative to collet 360' in the neutral position. Specifically, adjustment ring 261 and mandrel 255 may be rotated about axis 105 in a first direction to move mandrel 255 and trigger sleeve 381 coupled thereto with split ring 387 axially downward. Alternatively, adjustment ring 261 and mandrel 255 may be rotated about axis 105 in the opposite direction to move mandrel 255 and trigger sleeve 381 coupled thereto with split ring 387 axially upward. It should be appreciated that housing shoulder 252 limits the extent of upward movement of trigger sleeve 381 relative to collet 360'.

Figure 7:
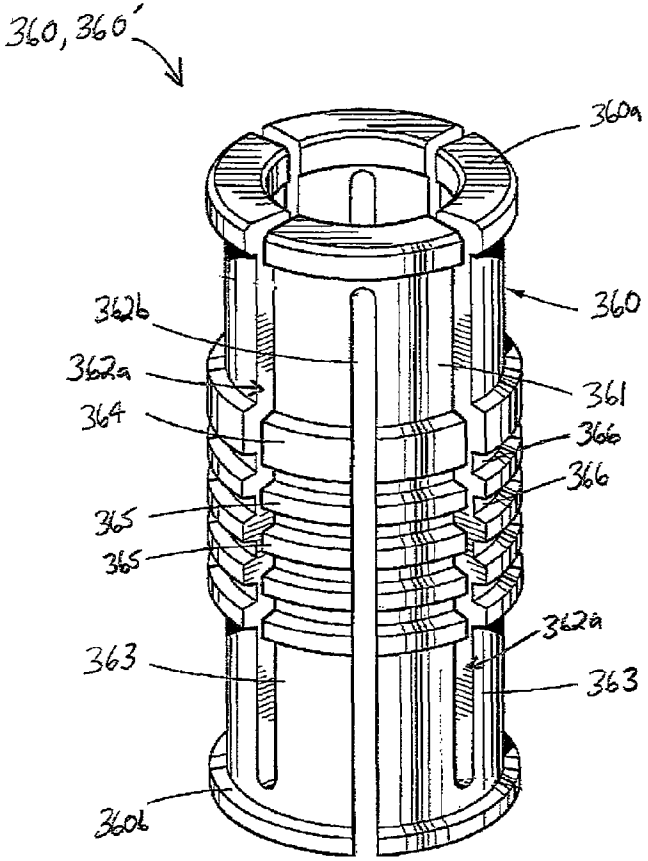
FIG. 7 is a perspective view of one of the collets of the jar of FIGS. 2A-2D.

Referring now to FIGS. 2C, 4, and 7, collet 360' of lock assembly 370 is radially disposed between mandrel 110 and trigger sleeve 381. As previously described, collet 360' is substantially the same as collet 360 of actuation assembly 340 previously described and shown in FIG. 5. However, flanges 367, 368 and recesses 369 of collet 360' of lock assembly 370 are sized and configured to releasably mesh with and engage mandrel recesses 141 and flanges 142, respectively, and flanges 364, 365 are sized and configured to releasably mesh with and engage recesses 385 and flanges 386, respectively, of trigger sleeve 381.

When collet flanges 367, 368 and recesses 369 positively engage mandrel recesses 141 and flanges 142, respectively, collet 360' is secured to mandrel 110 and moves axially along with mandrel 110. However, when collet flanges 364, 365 and recesses 366 positively engage trigger sleeve recesses 385 and flanges 386, respectively, collet 360' is secured to trigger sleeve 381 and mandrel 110 is free to move axially relative to lock assembly collet 360. Thus, collet 360' of lock assembly 370 may be described as having a first position secured to mandrel 110 and a second position secured to trigger sleeve 381. Collet 360' transitions from the first position to the second position as collet flanges 364, 365 and recesses 366 come into alignment with trigger sleeve recesses 385 and flanges 386, respectively, and simultaneously move into positive engagement with trigger sleeve recesses 385 and flanges 386, respectively, and out of engagement with mandrel recesses 141 and flanges 142, respectively. Further, collet 360' transitions from the second position to the first position as collet flanges 364, 365 and recesses 366 come into alignment with mandrel recesses 141 and flanges 142, respectively, and simultaneously move into positive engagement with mandrel recesses 141 and flanges 142, respectively, and out of engagement with trigger sleeve recesses 385 and flanges 386, respectively.

The jarring movement of jar 100 may be understood by referring to FIGS. 2A-2D and FIGS. 8A-8D. FIGS. 2A-2D show jar 100 in the unloaded, neutral, unfired position, whereas FIGS. 8A-8D show jar 100 in the fired position with hammer surface 124 engaging anvil surface 303.

As best shown in FIGS. 2B and 2C, with jar 100 in the neutral position, collet 360 of actuation assembly 340 and collet 360' of lock assembly 370 each positively engage mandrel 110. Namely, collet flanges 367, 368 and recesses 369 of collet 360 positively engage mandrel recesses 132 and flanges 133, respectively, and collet flanges 367, 368 of collet 360' positive engage mandrel recesses 141 and flanges 142, respectively. Thus, both collets 360, 360' move axially along with mandrel 110 relative to housing 210 and trigger sleeves 351, 381.

When jar 100 or downhole component coupled to jar 100 (e.g., tool 30) becomes stuck downhole, the operator applies a lifting force to jar 100 from the surface in an attempt to dislodge the stuck component. As a result, jar 100 is placed in tension—upper end 100*a* and mandrel 110 are pulled upward (e.g., by wireline 20) relative to lower end 100*b* and housing 210, which are stuck or connected to a stuck downhole component. In general, the range of permissible magnitudes of tensile loads, and thus the imparted upward jarring force, is limited only by the structural limits of jar 100 and the seals therein and by the string or wireline (e.g., wireline 20) that is supporting jar 100. When jar 100 is placed in tension in the neutral position, mandrel 110 and both collets 360, 360', which positively engaging mandrel 110, are urged axially upward relative to housing 210 and trigger sleeves 351, 381, which axially abut housing shoulders 242, 252, respectively.

The axial upward force applied to collet 360 by mandrel 110 is transferred to biasing member 341 by compression ring 350 and piston 345, and the axial force applied to collet 360' by mandrel 110 is transferred to biasing member 371 by compression ring 375. However, biasing members 341, 371 are compressed and preloaded in the neutral position such that each exerts an axial downward force on mandrel 110—biasing member 341 exerts an axial downward force on mandrel 110 via piston 345, compression ring 350 and collet 360, and biasing member 371 exerts an axial downward force on mandrel 110 via compression ring 375 and collet 360'. Both collets 360, 360' are secured to mandrel 110, and thus, mandrel 110 and collets 360, 360' do not move in response to tension applied to jar 100 unless and until the tensile force applied to jar 100 exceeds the total preload provided by biasing members 341, 371 (i.e., the sum of the preloads provided by biasing members 341, 371). In other words, biasing members 341, 371 share the tensile loads applied to jar 100. As previously described, in this embodiment, the preload of biasing member 371 is greater than the preload of biasing member 341. However, in other embodiments, the preload of the actuation assembly biasing member (e.g., biasing member 341) may be greater than the preload of the lock assembly biasing member (e.g., biasing member 381).

When the tension applied to jar 100 is sufficient to overcome the total preload of both biasing members 341, 371, mandrel 110 and collets 360, 360' secured thereto will begin to slowly move axially upward relative to housing 210 and trigger sleeves 351, 381. As biasing members 341, 371 are axially compressed, each generates an increasing spring force that resists continued axial upward movement of collets 360, 360' and mandrel 110. In addition, working fluid pressure in chamber upper portion 161*a* resist the axial upward movement of collets 360, 360' and mandrel 110 as piston 345 moves axially upward in chamber 161. That is, upward axial movement of piston 345 relative to the housing 210 reduces the volume of chamber upper portion 161*a* causing a significant increase in the working fluid pressure within portion 161*a*, thereby generating an axial hydraulic force that resist this relative movement. The hydraulic resistance to movement of piston 345 relative to housing 210 and the mechanical resistance to movement of piston 345 and compression ring 375 by biasing members 341, 371, respectively, allows a large buildup of potential energy in the working string when a tensile load is placed on jar 100 from the surface. With regard to the hydraulic resistance, it should be appreciated that over time, flow restrictor 348*a* allows working fluid to flow through piston 345 from chamber upper portion 161*a* to chamber lower portion 161*b*, thereby slowly relieving the pressure in chamber upper portion 161*a* and allowing piston 345 to move slowly upward within chamber 161 relative to housing 210.

If the tension applied to jar 100 is maintained at a level sufficient to overcome both biasing members 341, 371 (i.e., the preloads of both biasing members 341, 371 as well as the added spring forces from the additional compression of both biasing members 341, 371), mandrel 110 and collets 360, 360' secured thereto will continue to move axially upward relative to housing 210 and trigger sleeves 351, 381. Collets 360, 360' and trigger sleeves 351, 381, respectively, are sized and positioned such that flanges 364, 365 and recesses 366 of collet 360' come into alignment with mating recesses 385 and flanges 386, respectively, of trigger sleeve 381 before flanges 364, 365 and recesses 366 of collet 360 come into alignment with mating recesses 352 and flanges 353, respectively, of trigger sleeve 351 as collets 360, 360' and mandrel 110 move axially upward relative to housing 210 and trigger sleeves 351, 381.

Figure 8B:
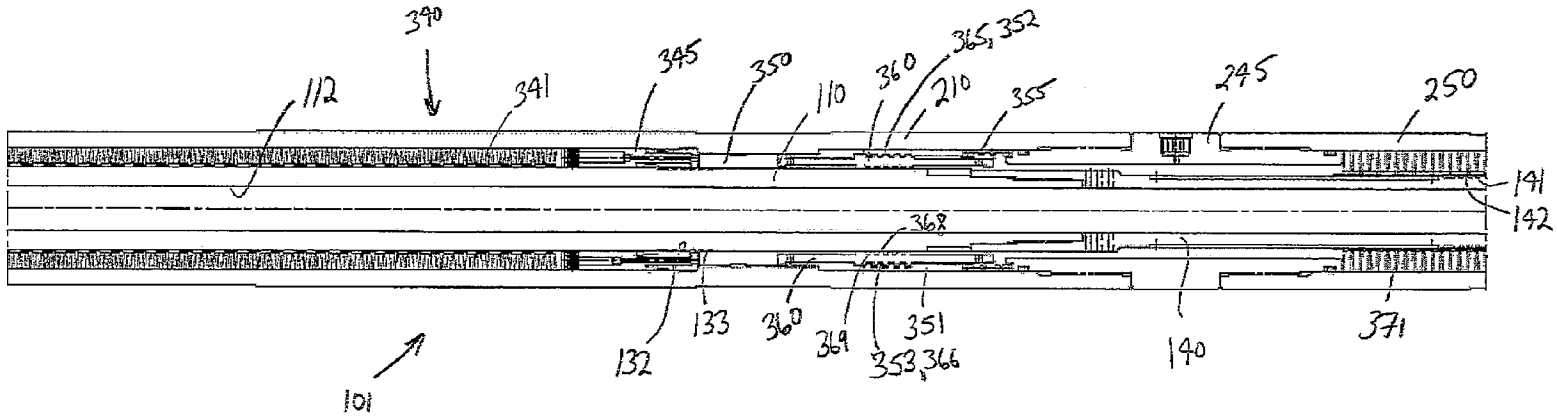
Figure 8C:
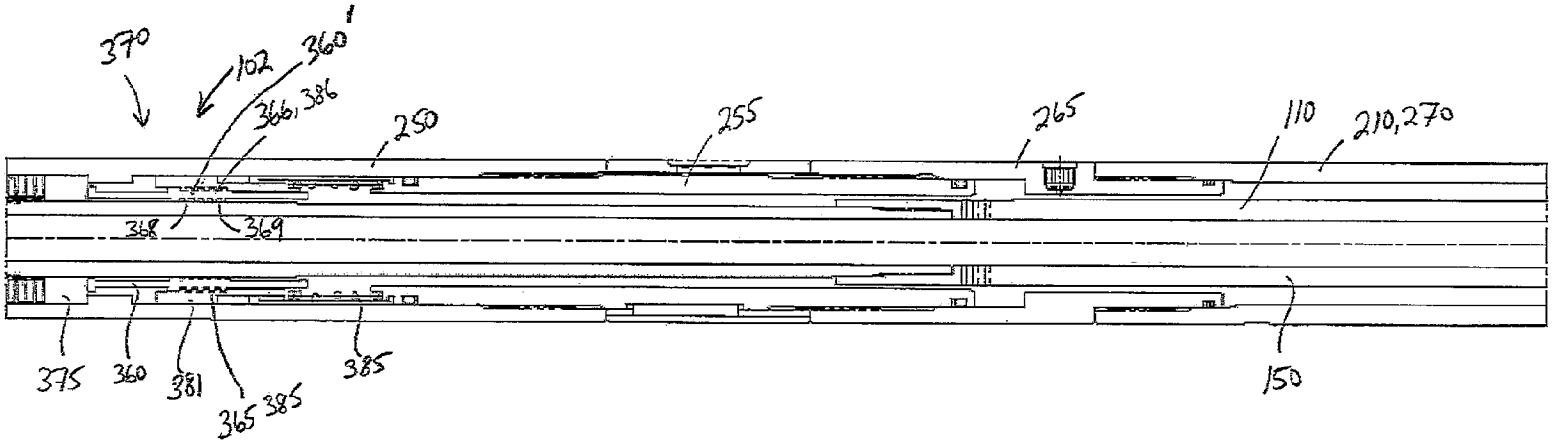
Figure 8D:
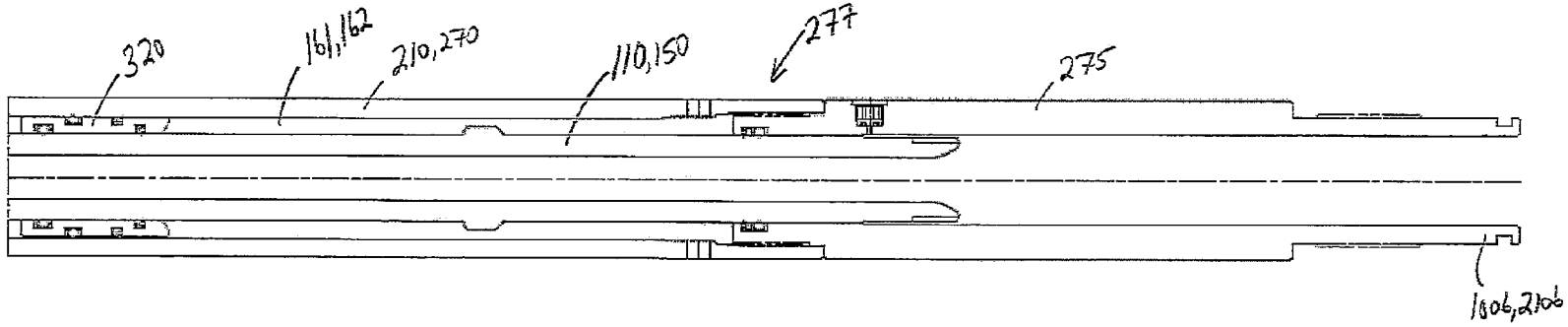

As best shown in FIG. 8C, when the primary outwardly facing flange 364 of collet 360' just clears the uppermost flange 386 of trigger sleeve 381, outwardly projecting flanges 365 come into substantial alignment with mating recesses 385 of trigger sleeve 381, and fingers 363 of collet 360' are cammed radially outward until flanges 364, 365 seat in mating recesses 385 of trigger sleeve 381. In particular, once radial clearance is provided for flanges 364, 365, sliding engagement of angled surfaces of mandrel flanges 142 and collet recesses 369, and sliding engagement of angled surfaces of mandrel recesses 141 and collet flanges 368 urge fingers 363 radially outward. At that point, outwardly projecting mandrel flanges 142 radially clear inwardly projecting flanges 368, collet 360' fully disengages mandrel 110, and mandrel 110 is released from the retarding action of lock assembly biasing member 371. In other words, once collet 360' moves out of engagement with mandrel 110 and into engagement with trigger sleeve 381, the spring force generated by biasing member 371 is no longer transferred to mandrel 110.

Once collet 360' of lock assembly 370 moves out of engagement with mandrel 110, the tensile load applied to jar 100 is substantially or entirely carried by actuation assembly 340. If that applied tensile load is sufficient to overcome biasing member 341 (i.e., the tensile load is greater than the sum of the preload of biasing member 341 as well as the added spring force from the additional compression of biasing members 341), mandrel 110 and collet 360 secured thereto will continue to be urged axially upward. As previously described, compression of the hydraulic fluid in chamber upper portion 161*a* by piston 345 hydraulically resists movement of piston 345, collet 360, and mandrel 110 relative to housing 210. However, over a period of time referred to as the "hydraulic delay" of firing section 101, flow restrictor 348*a* allows working fluid to flow through piston 345 from chamber upper portion 161*a* to chamber lower portion 161*b*, and thereby allows piston 345 to creep slowly upward within chamber 161 relative to housing 210. In this manner, piston 345 and flow restrictor 348*a* enable a significant overpull to be applied to mandrel 110 followed by a gradual bleed off of fluid pressure through the piston 345 and eventual triggering of the jar 100. In general, the hydraulic delay may be controllably adjusted by varying the relative axial positions of trigger sleeve 351 and collet 360 in the neutral position (i.e., the short the axial distance collet 360 must move to align flanges 364, 365 and recesses 366 with mating recesses 352 and flanges 353 of trigger sleeve 351, the shorter the hydraulic delay of firing section 101).

With sufficient tension applied to jar 100, piston 345, mandrel 110, and collet 360 moves axially upward relative to housing 210 and trigger sleeve 351. As best shown in FIG. 8B, when the primary outwardly facing flange 364 of collet 360 just clears the uppermost flange 353 of trigger sleeve 351, outwardly projecting flanges 365 will be in substantial alignment with mating recesses 352 of trigger sleeve 351, and fingers 363 of collet 360 are cammed radially outward until flanges 364, 365 seat in mating recesses 352 of trigger sleeve 351. In particular, once radial clearance is provided for flanges 364, 365, sliding engagement of angled surfaces of mandrel flanges 133 and collet recesses 369, and sliding engagement of angled surfaces of mandrel recesses 132 and collet flanges 368 urge fingers 363 radially outward. At that point, outwardly projecting mandrel flanges 133 radially clear inwardly projecting flanges 368, collet 360 fully disengages mandrel 110. Without the resistance provided by biasing member 341, mandrel 110 accelerates upward rapidly propelling hammer surface 124 into anvil surface 303, thereby generating the upward impact and jarring load to jar 100 and components coupled thereto, as shown in FIG. 8A.

If tension on mandrel 110 is released subsequent to firing jar 100, recocking biasing member 332 urges mandrel 110 axially downward to the position shown in FIG. 1B. In addition, biasing members 341, 381 urge collets 360, 360', respectively, axially downward. As mandrel flanges 133 come into alignment with mating recesses 369 of collet 360, the downward axial force provided by biasing member 341 will cause fingers 363 to cam radially inward and urge collet flanges 367, 368 into positive engagement with mandrel recesses 132. Similarly as mandrel flanges 142 come into alignment with mating recesses 369 of collet 360', the downward axial force provided by biasing member 371 will cause fingers 363 to cam radially inward and urge collet flanges 367, 368 into positive engagement with mandrel recesses 141. As each collet 360, 360' positively engages mandrel 110 and disengages trigger sleeves 351, 381, respectively, biasing members 355, 385 urge trigger sleeves 351, 381, respectively, back to the position shown in FIGS. 2B and 2C. The downward movement of piston 345 relative to housing 210 is accompanied by a flow of working fluid up through piston 345.

Collet 360 of actuation assembly 340 provides for relatively short firing or metering stroke. The metering stroke is defined approximately by the distance between primary flanges 364 and the lowermost secondary flanges 365. This relatively short metering stroke minimizes bleed off or lost potential energy and minimizes the amount of working fluid that must pass through piston 345, thereby reducing heat buildup on the fluid.

As previously described, each collet 360, 360' is provided with a plurality of principal outwardly projecting flanges 364 that are axially wider than recesses 352, 385 in sleeves 351, 381, respectively. This deliberate mismatch in dimensions is designed to prevent one or more of secondary outwardly projecting collet flanges 365 from prematurely engaging and locking into one of lower recesses 352, 385. Such a premature engagement between the outwardly projecting secondary flanges 365 and recesses 352, 385 might prevent the additional axial movement of the mandrel 110 or result in a premature release of mandrel 110 and thus insufficient application of upward jarring force.

In general, the components of embodiments of jars described herein (e.g., jar 100) may be made from any suitable material(s) including, without limitation, metals and metal alloys (e.g., steel, aluminum, etc.), non-metals (e.g., polymers, ceramics, etc.), composites, or combinations thereof. For harsh downhole conditions, the components are preferably made from rigid, durable materials such as mild and alloy steels, stainless steels or the like. Wear surfaces, such as the exterior of the mandrel (e.g., mandrel 110), may be carbonized to provided a harder surface.

In the manner described, embodiments of jar 100 described herein allow the triggering load of jar firing section 101 to be exceeded for a period of time before triggering jar 100 to fire. Specifically, both biasing members 341, 371 provide preload and axial forces resisting upward movement of mandrel 110 and collets 360, 360' when jar 100 is placed in tension. If the applied tension is sufficient to overcome both biasing members 341, 371, and is maintained for a sufficient period of time, collet 360' of lock assembly 370 will disengage mandrel 110, and only then does firing section 101 begin its firing cycle. Even if collet 360' disengages mandrel 110 and the applied tension is maintained at a level sufficient to overcome biasing member 341, the hydraulic delay required for piston 345 to move through chamber 161 provides the operate added time to decide whether to reduce line tension and avoid jarring, or allow jarring to proceed.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A jar having a longitudinal axis, comprising:

a housing including an anvil;

a mandrel telescopically disposed within the housing and including a hammer;

an annular chamber radially positioned between the mandrel and the housing;

an actuation assembly disposed in the annular chamber, the actuation assembly including:

a first collet disposed about the mandrel and adapted to releasably engage the mandrel, wherein the first collet is axially moveable between a neutral position engaging the mandrel and a triggered position disengaged from the mandrel;

a first trigger sleeve disposed about the first collet and adapted to releasably engage the first collet;

a first biasing member adapted to exert an axial force on the mandrel upon compression of the first biasing member by movement of the mandrel in a first axial direction relative to the housing when the first collet is in the neutral position;

a lock assembly disposed in the annular chamber, the lock assembly including:

a second collet disposed about the mandrel and adapted to releasably engage the mandrel, wherein the second collet is axially moveable between a neutral position engaging the mandrel and a triggered position disengaged from the mandrel;

a second trigger sleeve disposed about the second collet and adapted to releasably engage the second collet;

a second biasing member adapted to exert an axial force on the mandrel upon compression of the second biasing member by movement of the mandrel in the first axial direction relative to the housing when the second collet is in the neutral position;

wherein the lock assembly is adapted to release the mandrel, and wherein the actuation assembly is adapted to release the mandrel and allow to the hammer to axially impact the anvil.

2. The jar of claim 1, wherein the actuation assembly further comprises an annular piston disposed about the mandrel and sealingly engaging the mandrel and the housing, wherein the piston includes a first flow passage extending axially therethrough;

wherein the first biasing member is axially positioned between a shoulder of the housing and the piston.

3. The jar of claim 2, wherein each biasing member comprises a stack of Bellville springs.

4. The jar of claim 2, wherein the first flow passage includes an orifice adapted to restrict flow of fluid through the first flow passage in a second axial direction opposite the first axial direction.

5. The jar of claim 4, wherein the piston includes a second flow passage extending axially therethrough, the second flow passage including a check valve adapted to prevent fluid flow through the second flow passage in the second axial direction and allow fluid flow through the second flow passage in the first axial direction.

6. The jar of claim 2, wherein the housing includes an adjustment mandrel adapted to change the axial position of the second trigger sleeve relative to the second collet.

7. The jar of claim 6, wherein the adjustment mandrel has a first end coupled to the second trigger sleeve, a second end opposite the first end, a first set of external threads proximal the first end and a second set of external threads proximal the second end;

wherein the first set of external threads are threaded opposite to the second set of external threads;

wherein the first set of external threads engage a set of mating internal threads on an axially adjacent tubular member of the housing and the second set of external threads engage a set of mating internal threads on an axially adjacent tubular member.

8. The jar of claim 1, wherein the first biasing member has a compressive preload and the second biasing member of the lock assembly has a compressive preload.

9. The jar of claim 8, wherein the compressive preload of the first biasing member of is less than the compressive preload of the second biasing member.

10. A jar having a longitudinal axis, comprising:

a housing including an anvil surface;

a mandrel telescopically disposed within the housing and including a hammer surface;

a seal assembly radially disposed between the housing and the mandrel;

an annular hydraulic chamber radially positioned between the mandrel and the housing and extending axially from the seal assembly to an annular balancing piston disposed about the mandrel;

an annular actuation piston disposed in the hydraulic chamber and axially positioned between the seal assembly and the balance piston;

a first biasing member disposed in the hydraulic chamber and axially positioned between the actuation piston and a first annular shoulder on the housing, wherein the first biasing member biases the actuation piston in a first axial direction;

a first trigger sleeve disposed in the hydraulic chamber about the mandrel;

a first collet disposed in the hydraulic chamber about the mandrel, wherein the first collet has a first position positively engaging the mandrel and the second position positively engaging the first trigger sleeve;

wherein the first collet and the actuation piston are adapted to move with the mandrel relative to the housing and the first trigger sleeve when the first collet is in the first position, and the mandrel is adapted to move relative to the first collet and the actuation piston when the first collet is in the second position;

a second trigger sleeve disposed in the hydraulic chamber about the mandrel;

a second collet disposed in the hydraulic chamber about the mandrel, wherein the second collet has a first position positively engaging the mandrel and the second position positively engaging the second trigger sleeve;

a second biasing member axially positioned between a second annular shoulder on the housing and the second collet;

wherein the second collet is adapted to move with the mandrel relative to the housing and the second trigger sleeve when the second collet is in the first position, and the mandrel is adapted to move relative to the second collet when the second collet is in the second position.

11. The jar of claim 10, wherein the actuation piston includes a first flow passage extending axially therethrough and a flow restriction orifice disposed in the flow passage;

wherein the piston includes a second flow passage extending axially therethrough and a check valve disposed in the second flow passage.

12. The jar of claim 10, wherein the first biasing member is axially compressed when the first collet is in the first position, and the second biasing member is axially compressed when the second collet is in the first position.

13. The jar of claim 10, wherein the housing includes an adjustment mandrel adapted to change the axial position of the second trigger sleeve relative to the second collet;

wherein the adjustment mandrel has a first end coupled to the second trigger sleeve of, a second end opposite the first end, a first set of external threads proximal the first end, and a second set of external threads proximal the second end, the first set of external threads being threaded opposite to the second set of external threads;

wherein the first set of external threads engage a set of mating internal threads on an axially adjacent tubular member of the housing and the second set of external threads engage a set of mating internal threads on an axially adjacent tubular member.

14. A method of operating a downhole jar, the jar including a housing with a longitudinal axis and a mandrel telescopically disposed within the housing, the method comprising:

(a) applying a tensile load to the jar so as to move the mandrel relative to the housing in a first axial direction;

(b) compressing a first biasing member that biases the mandrel in a second axial direction that is opposite the first axial direction with a first biasing force;

(c) removing the first biasing force from the mandrel after sufficient axial movement of the mandrel relative to the housing;

(d) continuing to apply a tensile load to the jar so as to move the mandrel relative to the housing after (c); and (e) compressing a second biasing member that biases the mandrel in the second axial direction with a second biasing force during (d).

15. The method of claim 14, further comprising:

(f) removing the second biasing force from the mandrel after sufficient axial movement of the mandrel relative to the housing; and (g) applying an axial impact force to the housing with the mandrel upon removal of the first biasing force and the second biasing force from the mandrel.

16. The method of claim 15, wherein (c) comprises moving a first collet out of positive engagement with the mandrel, and (f) comprises moving a second collet out of positive engagement with the mandrel.

17. The method of claim 16, further comprising:

moving the first collet and the second collet axially relative to the housing with the mandrel during (b); and moving the second collet axially relative to the housing with the mandrel during (d).

18. The method of claim 14, further comprising resisting the movement of the mandrel in the second axial direction with a hydraulic force during (d).

19. The method of claim 18, wherein the jar includes an annular chamber radially disposed between the housing and the mandrel and an annular piston disposed in the chamber; and wherein axial movement of the piston through the chamber in the first axial direction compresses a working fluid that resists the movement of the piston and the mandrel in the first axial direction.

20. The method of claim 14, wherein the first biasing force is provided by the axial compression a first stack of Bellville springs and the second biasing force is provided by the axial compression of a second stack of Bellville springs.

21. The method of claim 14, further comprising:

preloading the first biasing member by axially compressing the first biasing member before (a); and preloading the second biasing member by axially compressing the second biasing member before (a).

* * * * *